US008621681B2

(12) United States Patent
Macan et al.

(10) Patent No.: US 8,621,681 B2
(45) Date of Patent: Jan. 7, 2014

(54) ARTICULATING SHOWER ARM

(75) Inventors: Aaron Damian Macan, Loveland, CO (US); Harold A. Luettgen, Windsor, CO (US)

(73) Assignee: Water Pik, Inc., Fort Collins, CO (US)

( * ) Notice: Subject to any disclaimer, the term of this patent is extended or adjusted under 35 U.S.C. 154(b) by 23 days.

(21) Appl. No.: 13/245,566

(22) Filed: Sep. 26, 2011

(65) Prior Publication Data

US 2012/0086199 A1 Apr. 12, 2012

Related U.S. Application Data

(63) Continuation of application No. 11/151,947, filed on Jun. 14, 2005, now Pat. No. 8,024,822.

(60) Provisional application No. 60/579,436, filed on Jun. 14, 2004, provisional application No. 60/598,706, filed on Aug. 3, 2004.

(51) Int. Cl.
*A47K 3/00* (2006.01)

(52) U.S. Cl.
USPC ..... 4/615

(58) Field of Classification Search
USPC ..... 4/615, 567, 568, 570, 675, 678; 239/587.1, 587.2, 587.5
See application file for complete search history.

(56) References Cited

U.S. PATENT DOCUMENTS

| | | | |
|---|---|---|---|
| 203,094 | A | 4/1878 | Wakeman |
| 428,023 | A | 5/1890 | Schoff |
| 445,250 | A | 1/1891 | Lawless |
| 486,986 | A | 11/1892 | Schinke |
| 566,410 | A | 8/1896 | Schinke |
| 570,405 | A | 10/1896 | Jerguson et al. |
| 800,802 | A | 10/1905 | Franquist |
| 832,523 | A | 10/1906 | Andersson |
| 854,094 | A | 5/1907 | Klein |
| 926,929 | A | 7/1909 | Dusseau |
| 1,001,842 | A | 8/1911 | Greenfield |
| 1,003,037 | A | 9/1911 | Crowe |
| 1,018,143 | A | 2/1912 | Vissering |

(Continued)

FOREIGN PATENT DOCUMENTS

| | | |
|---|---|---|
| AU | 687527 | 11/1996 |
| CA | 659510 | 3/1963 |

(Continued)

OTHER PUBLICATIONS

"Showermaster 2" advertisement, Showermaster, P.O. Box 5311, Coeur d'Alene, ID 83814, as early as Jan. 1997.

*Primary Examiner* — Huyen Le
(74) *Attorney, Agent, or Firm* — Dorsey & Whitney LLP

(57) ABSTRACT

An improved shower arm having an elbow portion adapted to fluidly communicate with a shower head and an arm portion adapted to fluidly communicate with a water supply. The arm portion is pivotably coupled with the elbow portion about a long axis of the elbow portion, with the long axis of the elbow portion and a long axis of the arm portion forming an angle. Also, the shower arm includes a locking mechanism having one or more sets of splines to securely lock the relative position of the arm and elbow portions. The splines may be coupled and decoupled by a variety of mechanisms, including: hydraulic pressure generated by a restrictor plate; a spring forcing the sets of splines together; and a pair of magnets.

22 Claims, 19 Drawing Sheets

(56) References Cited

U.S. PATENT DOCUMENTS 1,193,302 A 8/1916 Seltner
1,207,380 A 12/1916 Duffy
1,217,254 A 2/1917 Winslow
1,218,895 A 3/1917 Porter
1,255,577 A 2/1918 Berry
1,260,181 A 3/1918 Garnero
1,276,117 A 8/1918 Riebe
1,284,099 A 11/1918 Harris
1,327,428 A 1/1920 Gregory
1,451,800 A 4/1923 Agner
1,469,528 A 10/1923 Owens
1,500,921 A 7/1924 Bramson et al.
1,560,789 A 11/1925 Johnson et al.
1,597,477 A 8/1926 Panhorst
1,692,394 A 11/1928 Sundh
1,695,263 A 12/1928 Jacques
1,724,147 A 8/1929 Russell
1,736,160 A 11/1929 Jonsson
1,754,127 A 4/1930 Srulowitz
1,758,115 A 5/1930 Kelly
1,778,658 A 10/1930 Baker
1,821,274 A 9/1931 Plummer
1,906,575 A 5/1933 Goeriz
2,011,446 A 8/1935 Judell
2,024,930 A 8/1935 Judell
2,044,445 A 6/1936 Price et al.
2,117,152 A 5/1938 Crosti
2,196,783 A 4/1940 Shook
2,197,667 A 4/1940 Shook
2,268,263 A 5/1941 Newell et al.
2,342,757 A 2/1944 Roser
D147,258 S 8/1947 Becker
D152,584 S 2/1949 Becker
2,467,954 A 4/1949 Becker
2,472,030 A * 5/1949 Thulin ..... 4/567
2,546,348 A 3/1951 Schuman
2,581,129 A 1/1952 Muldoon
D166,073 S 3/1952 Dunkelberger
2,648,762 A 8/1953 Dunkelberger
2,664,271 A 12/1953 Arutunoff
2,676,806 A 4/1954 Bachman
2,679,575 A 5/1954 Haberstump
2,680,358 A 6/1954 Zublin
2,721,089 A 10/1955 Shames
2,759,765 A 8/1956 Pawley
2,776,168 A 1/1957 Schweda
2,825,135 A 3/1958 Tilden
2,873,999 A 2/1959 Webb
2,931,672 A 4/1960 Merritt et al.
2,966,311 A 12/1960 Davis
D190,295 S 5/1961 Becker
D192,935 S 5/1962 Becker
3,032,357 A 5/1962 Shames et al.
3,034,809 A 5/1962 Greenberg
3,064,998 A * 11/1962 Syverson ..... 285/101
3,103,723 A 9/1963 Becker
3,111,277 A 11/1963 Grimsley
3,121,235 A 2/1964 Gellmann
3,143,857 A 8/1964 Eaton
3,196,463 A 7/1965 Farneth
3,231,200 A 1/1966 Heald
3,266,059 A 8/1966 Stelle
3,306,634 A 2/1967 Groves et al.
3,329,967 A 7/1967 Martinez et al.
3,389,925 A 6/1968 Gottschald
3,393,311 A 7/1968 Dahl
3,393,312 A 7/1968 Dahl
3,402,893 A 9/1968 Hindman
3,492,029 A 1/1970 French et al.
3,546,961 A 12/1970 Marton
3,565,116 A 2/1971 Gabin
3,584,822 A 6/1971 Oram
3,612,577 A 10/1971 Pope
3,641,333 A 2/1972 Gendron
3,663,044 A 5/1972 Contreras et al.
3,669,362 A 6/1972 Meyerhofer et al.
3,669,470 A 6/1972 Deurloo
3,685,745 A 8/1972 Peschcke-Koedt
3,731,084 A 5/1973 Trevorrow
3,754,779 A 8/1973 Peress
3,778,610 A 12/1973 Wolf
3,860,271 A 1/1975 Rodgers
3,861,719 A 1/1975 Hand
3,869,151 A 3/1975 Fletcher et al.
3,910,277 A 10/1975 Zimmer
D237,708 S 11/1975 Grohe
3,929,164 A 12/1975 Richter
3,931,992 A 1/1976 Coel
D240,178 S 6/1976 Johansen
D240,322 S 6/1976 Staub
3,971,074 A 7/1976 Yxfeldt
4,005,880 A 2/1977 Anderson et al.
4,006,920 A 2/1977 Sadler et al.
4,023,782 A 5/1977 Eifer
4,045,054 A 8/1977 Arnold
D249,356 S 9/1978 Nagy
4,162,801 A 7/1979 Kresky et al.
4,174,822 A 11/1979 Larsson
4,243,253 A 1/1981 Rogers, Jr.
4,258,414 A 3/1981 Sokol
4,274,400 A 6/1981 Baus
4,282,612 A 8/1981 King
D262,353 S 12/1981 Kitson
4,358,056 A 11/1982 Greenhut et al.
D268,442 S 3/1983 Darmon
4,383,554 A 5/1983 Merriman
4,396,797 A 8/1983 Sakuragi et al.
4,425,965 A 1/1984 Bayh, III et al.
4,465,308 A 8/1984 Martini
4,479,610 A 10/1984 Etheridge et al.
4,495,550 A 1/1985 Visciano
4,540,202 A 9/1985 Amphoux et al.
4,545,081 A 10/1985 Nestor et al.
4,545,535 A 10/1985 Knapp
4,553,775 A 11/1985 Halling
D281,820 S 12/1985 Oba et al.
4,568,216 A 2/1986 Mizusawa et al.
4,571,003 A 2/1986 Roling et al.
D283,645 S 4/1986 Tanaka
4,643,463 A 2/1987 Halling et al.
4,645,244 A 2/1987 Curtis
4,651,770 A 3/1987 Denham et al.
4,652,025 A 3/1987 Conroy, Sr.
4,669,757 A 6/1987 Bartholomew
4,683,917 A 8/1987 Bartholomew
4,707,770 A 11/1987 Van Duyn
4,717,180 A 1/1988 Roman
4,722,029 A 1/1988 Ahle et al.
4,733,337 A 3/1988 Bieberstein
4,739,801 A 4/1988 Kimura et al.
4,752,975 A 6/1988 Yates
4,790,294 A 12/1988 Allred, III et al.
4,809,369 A 3/1989 Bowden
4,839,599 A 6/1989 Fischer
4,842,059 A 6/1989 Tomek
D302,325 S 7/1989 Charet et al.
4,850,616 A 7/1989 Pava
4,856,822 A 8/1989 Parker
4,863,328 A 9/1989 Malek
4,865,362 A 9/1989 Holden
4,871,196 A 10/1989 Kingsford
D306,351 S 2/1990 Charet et al.
4,901,765 A 2/1990 Poe
4,901,927 A 2/1990 Valdivia
4,903,178 A 2/1990 Englot et al.
4,907,137 A 3/1990 Schladitz et al.
4,946,202 A 8/1990 Perricone
4,951,329 A 8/1990 Shaw
4,959,758 A 9/1990 Filosa et al.
4,964,573 A 10/1990 Lipski
4,972,048 A 11/1990 Martin
4,975,123 A 12/1990 Gray
D314,246 S 1/1991 Bache
5,004,158 A 4/1991 Halem et al.

(56) References Cited

U.S. PATENT DOCUMENTS

| | | | |
|---|---|---|---|
| 5,022,103 | A | 6/1991 | Faist |
| 5,032,015 | A | 7/1991 | Christianson |
| 5,033,528 | A | 7/1991 | Volcani |
| 5,046,764 | A | 9/1991 | Kimura et al. |
| D321,062 | S | 10/1991 | Bonbright |
| D322,681 | S | 12/1991 | Yuen |
| 5,071,070 | A | 12/1991 | Hardy |
| 5,086,878 | A | 2/1992 | Swift |
| D325,769 | S | 4/1992 | Haug et al. |
| 5,103,384 | A | 4/1992 | Drohan |
| 5,107,406 | A | 4/1992 | Sekido et al. |
| 5,134,251 | A | 7/1992 | Martin |
| 5,135,173 | A | 8/1992 | Cho |
| D329,504 | S | 9/1992 | Yuen |
| 5,143,123 | A | 9/1992 | Richards et al. |
| 5,148,556 | A | 9/1992 | Bottoms, Jr. et al. |
| 5,153,976 | A | 10/1992 | Benchaar et al. |
| 5,154,483 | A | 10/1992 | Zeller |
| 5,163,752 | A | 11/1992 | Copeland et al. |
| 5,197,767 | A | 3/1993 | Kimura et al. |
| 5,215,338 | A | 6/1993 | Kimura et al. |
| 5,220,697 | A | 6/1993 | Birchfield |
| D337,839 | S | 7/1993 | Zeller |
| D338,542 | S | 8/1993 | Yuen |
| 5,254,809 | A | 10/1993 | Martin |
| D341,220 | S | 11/1993 | Eagan |
| 5,263,646 | A | 11/1993 | McCauley |
| 5,265,833 | A | 11/1993 | Heimann et al. |
| 5,268,826 | A | 12/1993 | Greene |
| 5,276,596 | A | 1/1994 | Krenzel |
| 5,286,071 | A | 2/1994 | Storage |
| 5,288,110 | A | 2/1994 | Allread |
| D345,811 | S | 4/1994 | Van Deursen et al. |
| 5,333,787 | A | 8/1994 | Smith et al. |
| 5,333,789 | A | 8/1994 | Garneys |
| 5,340,165 | A | 8/1994 | Sheppard |
| 5,349,987 | A | 9/1994 | Shieh |
| 5,356,076 | A | 10/1994 | Bishop |
| 5,368,235 | A | 11/1994 | Drozdoff et al. |
| 5,369,556 | A | 11/1994 | Zeller |
| 5,370,427 | A | 12/1994 | Hoelle et al. |
| 5,385,500 | A | 1/1995 | Schmidt |
| D356,626 | S | 3/1995 | Wang |
| 5,398,977 | A | 3/1995 | Berger et al. |
| D361,399 | S | 8/1995 | Carbone et al. |
| 5,449,206 | A | 9/1995 | Lockwood |
| D363,360 | S | 10/1995 | Santarsiero |
| 5,468,057 | A | 11/1995 | Megerle et al. |
| D364,935 | S | 12/1995 | deBlois |
| D365,625 | S | 12/1995 | Bova |
| D365,646 | S | 12/1995 | deBlois |
| D366,707 | S | 1/1996 | Kaiser |
| D366,708 | S | 1/1996 | Santarsiero |
| D366,709 | S | 1/1996 | Szymanski |
| D366,710 | S | 1/1996 | Szymanski |
| 5,481,765 | A | 1/1996 | Wang |
| D366,948 | S | 2/1996 | Carbone |
| D367,333 | S | 2/1996 | Swyst |
| D367,934 | S | 3/1996 | Carbone |
| D368,146 | S | 3/1996 | Carbone |
| D368,317 | S | 3/1996 | Swyst |
| D368,539 | S | 4/1996 | Carbone et al. |
| D368,540 | S | 4/1996 | Santarsiero |
| D368,541 | S | 4/1996 | Kaiser et al. |
| D368,542 | S | 4/1996 | deBlois et al. |
| D369,873 | S | 5/1996 | deBlois et al. |
| D369,874 | S | 5/1996 | Santarsiero |
| D369,875 | S | 5/1996 | Carbone |
| D370,277 | S | 5/1996 | Kaiser |
| D370,278 | S | 5/1996 | Nolan |
| D370,279 | S | 5/1996 | deBlois |
| D370,280 | S | 5/1996 | Kaiser |
| D370,281 | S | 5/1996 | Johnstone et al. |
| 5,517,392 | A | 5/1996 | Rousso et al. |
| 5,521,803 | A | 5/1996 | Eckert et al. |
| D370,542 | S | 6/1996 | Santarsiero |
| D370,735 | S | 6/1996 | DeBlois |
| D370,987 | S | 6/1996 | Santarsiero |
| D370,988 | S | 6/1996 | Santarsiero |
| D371,448 | S | 7/1996 | Santarsiero |
| D371,618 | S | 7/1996 | Nolan |
| D371,619 | S | 7/1996 | Szymanski |
| D371,856 | S | 7/1996 | Carbone |
| D372,318 | S | 7/1996 | Szymanski |
| D372,319 | S | 7/1996 | Carbone |
| 5,531,625 | A | 7/1996 | Zhong |
| D372,548 | S | 8/1996 | Carbone |
| D372,998 | S | 8/1996 | Carbone |
| D373,210 | S | 8/1996 | Santarsiero |
| D373,434 | S | 9/1996 | Nolan |
| D373,435 | S | 9/1996 | Nolan |
| D373,645 | S | 9/1996 | Johnstone et al. |
| D373,646 | S | 9/1996 | Szymanski et al. |
| D373,647 | S | 9/1996 | Kaiser |
| D373,648 | S | 9/1996 | Kaiser |
| D373,649 | S | 9/1996 | Carbone |
| D373,651 | S | 9/1996 | Szymanski |
| D373,652 | S | 9/1996 | Kaiser |
| D374,297 | S | 10/1996 | Kaiser |
| D374,298 | S | 10/1996 | Swyst |
| D374,299 | S | 10/1996 | Carbone |
| D374,493 | S | 10/1996 | Szymanski |
| D374,494 | S | 10/1996 | Santarsiero |
| D374,732 | S | 10/1996 | Kaiser |
| D374,733 | S | 10/1996 | Santarsiero |
| 5,567,115 | A | 10/1996 | Carbone |
| D376,217 | S | 12/1996 | Kaiser |
| D376,860 | S | 12/1996 | Santarsiero |
| D376,861 | S | 12/1996 | Johnstone et al. |
| D376,862 | S | 12/1996 | Carbone |
| 5,624,074 | A | 4/1997 | Parisi |
| D379,404 | S | 5/1997 | Spelts |
| D381,405 | S | 7/1997 | Waidele et al. |
| 5,660,079 | A | 8/1997 | Friedrich |
| 5,667,146 | A | 9/1997 | Pimentel et al. |
| 5,692,252 | A | 12/1997 | Zwezdaryk |
| 5,749,602 | A | 5/1998 | Delaney et al. |
| 5,778,939 | A | 7/1998 | Hok-Yin |
| D398,370 | S | 9/1998 | Purdy |
| D401,680 | S | 11/1998 | Tiernan |
| 5,865,378 | A | 2/1999 | Hollinshead et al. |
| D406,636 | S | 3/1999 | Male et al. |
| D413,157 | S | 8/1999 | Ratzlaff |
| 5,997,047 | A | 12/1999 | Pimentel et al. |
| 6,042,155 | A | 3/2000 | Lockwood |
| 6,095,801 | A | 8/2000 | Spiewak |
| 6,164,569 | A | 12/2000 | Hollinshead et al. |
| 6,164,570 | A | 12/2000 | Smeltzer |
| 6,199,729 | B1 | 3/2001 | Drzymkowski |
| D440,641 | S | 4/2001 | Hollinshead et al. |
| 6,227,456 | B1 | 5/2001 | Colman |
| 6,336,764 | B1 | 1/2002 | Liu |
| 6,382,531 | B1 | 5/2002 | Tracy |
| 6,425,149 | B1 | 7/2002 | Wang |
| 6,450,425 | B1 | 9/2002 | Chen |
| D465,553 | S | 11/2002 | Singtoroj |
| 6,511,001 | B1 | 1/2003 | Huang |
| D470,219 | S | 2/2003 | Schweitzer |
| 6,537,455 | B2 | 3/2003 | Farley |
| 6,626,210 | B2 | 9/2003 | Luettgen et al. |
| 6,629,651 | B1 | 10/2003 | Male et al. |
| 6,643,862 | B2 | 11/2003 | Aitken |
| 6,659,117 | B2 | 12/2003 | Gilmore |
| 6,701,953 | B2 | 3/2004 | Agosta |
| D496,446 | S | 9/2004 | Zwezdaryk |
| D502,761 | S | 3/2005 | Zieger et al. |
| 6,863,227 | B2 | 3/2005 | Wollenberg et al. |
| 6,926,212 | B1 | 8/2005 | Glass |
| D517,669 | S | 3/2006 | Zieger et al. |
| 7,066,411 | B2 | 6/2006 | Male et al. |
| D529,151 | S | 9/2006 | Macan et al. |
| D531,259 | S | 10/2006 | Hsieh |
| 7,147,172 | B2 | 12/2006 | Darling, III et al. |
| 7,201,331 | B2 | 4/2007 | Bertrand |

(56) References Cited

U.S. PATENT DOCUMENTS

| | | | | |
|---|---|---|---|---|
| 7,299,510 | B2 | 11/2007 | Tsai | |
| 7,533,906 | B2 | 5/2009 | Luettgen et al. | |
| D618,766 | S | 6/2010 | Whitaker et al. | |
| 7,905,429 | B2 | 3/2011 | Somerfield et al. | |
| 8,070,076 | B2 * | 12/2011 | Erickson et al. | 239/587.2 |
| 2002/0033424 | A1 | 3/2002 | Rivera et al. | |
| 2002/0070292 | A1 | 6/2002 | Hazenfield | |
| 2004/0163169 | A1 | 8/2004 | Kollmann et al. | |
| 2005/0283904 | A1 | 12/2005 | Macan et al. | |
| 2006/0208111 | A1 | 9/2006 | Tracy et al. | |
| 2006/0231648 | A1 | 10/2006 | Male et al. | |
| 2007/0251590 | A1 * | 11/2007 | Weinstein | 137/801 |
| 2008/0083844 | A1 | 4/2008 | Leber et al. | |
| 2008/0271240 | A1 | 11/2008 | Leber et al. | |

FOREIGN PATENT DOCUMENTS

| | | |
|---|---|---|
| CA | 2150317 | 11/1995 |
| DE | 352813 | 5/1922 |
| DE | 854100 | 10/1952 |
| DE | 2360534 | 6/1974 |
| DE | 2806093 | 8/1979 |
| DE | 3246327 | 12/1982 |
| DE | 4034695 | 5/1991 |
| DE | 4142198 | 4/1993 |
| DE | 19608085 | 3/1998 |
| EP | 0167063 | 6/1985 |
| EP | 0683354 | 11/1995 |
| EP | 0687851 | 12/1995 |
| EP | 0695907 | 2/1996 |
| EP | 0721082 | 7/1996 |
| FR | 538538 | 6/1922 |
| FR | 1098836 | 8/1955 |
| FR | 2596492 | 10/1987 |
| FR | 2695452 | 3/1994 |
| GB | 3314 | 0/1914 |
| GB | 10086 | 0/1893 |
| GB | 129812 | 7/1919 |
| GB | 204600 | 10/1923 |
| GB | 634483 | 3/1950 |
| GB | 971866 | 10/1964 |
| GB | 2156932 | 10/1985 |
| GB | 2298595 | 9/1996 |
| IT | 327400 | 7/1936 |
| IT | 350359 | 7/1937 |
| JP | S63-181459 | 11/1988 |
| JP | H2-78660 | 6/1990 |
| NL | 8902957 | 6/1991 |
| WO | WO93/12894 | 7/1993 |
| WO | WO93/25839 | 12/1993 |
| WO | WO96/23999 | 8/1996 |
| WO | WO98/30336 | 7/1998 |

* cited by examiner

ARTICULATING SHOWER ARM

CROSS-REFERENCE TO RELATED APPLICATIONS

This application is a continuation patent application of U.S. patent application Ser. No. 11/151,947, filed Jun. 14, 2005 now U.S. Pat. No. 8,024,822 and entitled "Articulating Shower Arm," which claims priority to U.S. Provisional Patent Application No. 60/579,436, titled "Articulating Shower Arm," filed Jun. 14, 2004, and U.S. Provisional Patent Application No. 60/598,706, titled "Articulating Shower Arm," filed Aug. 3, 2004, both of which are hereby incorporated by reference herein.

FIELD OF THE INVENTION

This invention relates generally to shower arms, and more particularly to shower arms that provide a pivotable connection between a water supply and a shower head or similar device.

BACKGROUND OF THE INVENTION

Many shower heads, which are employed primarily for purposes of maintaining personal hygiene and cleanliness, attach directly to a water supply pipe provided within a shower or enclosure. Most shower heads may pivot about or near the connection of the head and the water supply pipe. Such pivoting allows the user to direct the water emitted from the head to a desirable or useful location. However, such connections are often rather stiff, making pivoting of the shower head difficult. Alternately, these connections may become loose over time, thus preventing the shower head from maintaining a position set by the user.

Other shower heads currently available are instead connected to a water supply by way of a flexible hose, thus allowing the user to handle the shower head directly. In many such shower heads, the connection between the hose and the water supply incorporates a pivotable holder for the shower head so that the user may shower without holding the head. After a period of use, the holder tends to loosen, as described above, often requiring the user to manually tighten the holder periodically.

More recently, some shower heads are coupled to a water supply pipe by way of a shower arm that allows the shower head to pivot about the water supply pipe. Typically, the user loosens a thumbscrew or similar device to pivot the device to a desired position, and then tightens the screw to hold the shower head and attached arm in place by way of friction. Once again, after a period of use, such a mechanism often loosens so that the shower head and arm are not held in place securely, thus requiring the user to retighten the apparatus.

Accordingly, an improved shower arm would be advantageous.

SUMMARY OF THE INVENTION

One embodiment of the present invention takes the form of an articulating shower arm. In this embodiment, a shower arm having an elbow portion (or simply "elbow") is adapted to fluidly communicate with a water supply, and an arm portion (or simply "arm") may be adapted to fluidly communicate with a shower head. The arm portion is pivotably coupled with the elbow portion about a long axis of the elbow portion, with the long axis of the elbow portion and a long axis of the arm portion forming an angle. The arm portion and the elbow portion together include a continuous channel configured to fluidly connect the water supply with the shower head. Further, a mechanism allowing a user to selectively pivot and lock the position of the arm portion relative to the elbow portion is included. Alternate embodiments may provide only the elbow portion or arm portion.

In one embodiment of the invention, a wing nut is employed to actuate the locking mechanism. In a second embodiment, a push button is utilized in a similar fashion. Yet other embodiments may employ different working mechanisms. In both cases described herein, the locking mechanism may include two sets of splines or similar structures, such that when the sets of splines are engaged, the relative position of the arm and elbow portions is locked securely in place. Conversely, if the splines are disengaged, the arm portion is free to pivot about the long axis of the elbow portion.

In alternative embodiments, spring forces, hydraulic pressure, a ratchet and plunger combination, a ratchet and gear combination, or a nut and collet structure may all serve as locking mechanisms.

Other details and advantages of the various embodiments of the invention will become evident by virtue of the following detailed description, drawings, and claims.

DETAILED DESCRIPTION

Figure 1:
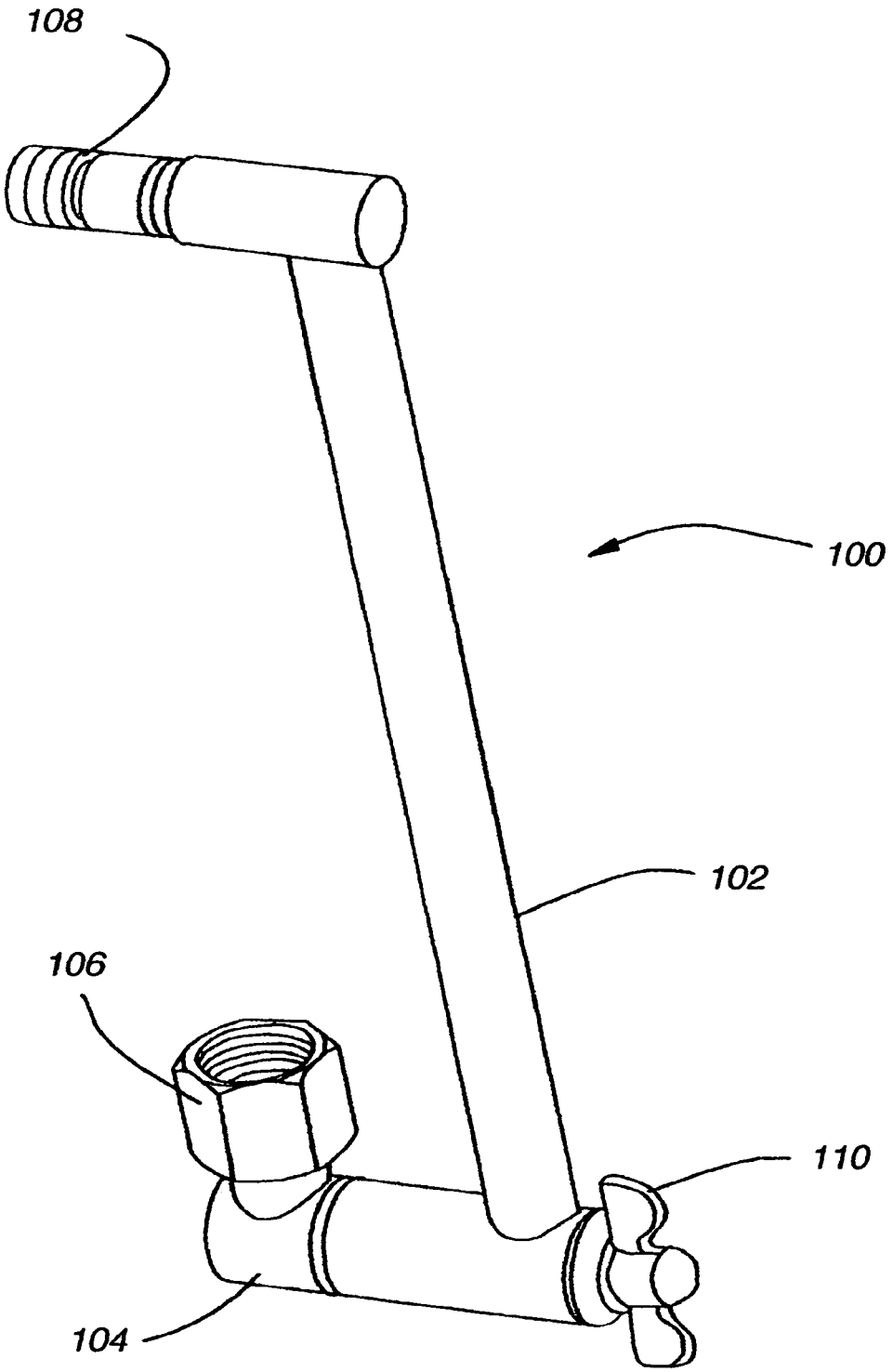
FIG. 1 depicts a perspective view of a shower arm according to a first embodiment of the present invention, employing a wing nut.

As shown in FIG. 1, one embodiment of the present invention takes the form of an articulating shower arm 100 including an arm portion 102 and an elbow portion 104 coupled together in a pivotable manner, as described below.

The elbow portion 104 further contains a water supply connector 106 for connection to a water supply pipe. Similarly, the arm portion 102 includes a shower head connector 108 for receiving a shower head in a watertight manner. The shower head connector 108 may take any of several forms compatible with an attached shower head.

The arm portion 102 and the elbow portion 104 are pivotably coupled, so that the arm portion 102 may be rotated to assume any of several positions about the long axis of the elbow portion 104. This pivotable coupling allows the shower head to assume several different positions about the elbow in relation to the water supply pipe. This, in turn, permits a user to position the shower head in any of a number of locations to account for (among other factors) the type of shower head used, position of the water supply pipe, the height of the user, size of the shower stall, and so on.

In FIG. 1, the long axis of the arm portion 102 and the long axis of the elbow portion 104 form a right angle. However, those of ordinary skill in the art will recognize that other angles may be formed by the arm portion 102 and the elbow portion 104 without diverting from the scope of the invention. Also in FIG. 1, the shower head connector 108 is positioned at a right angle to the long axis of the arm portion 102. Similarly, the water supply connector 106 is angled orthogonally to the long axis of the elbow portion 104. While this arrangement may represent the typical structure for the articulating shower arm 100, those of ordinary skill in the art will appreciate that other angles may be formed between either or all of the connectors 106, 108, the arm portion 102, and the elbow portion 104.

Further, the articulating shower arm 100 includes a wing nut 110, allowing a user to alter or lock the relative position of the arm portion 102 and the elbow portion 104, as described below.

Figure 2:
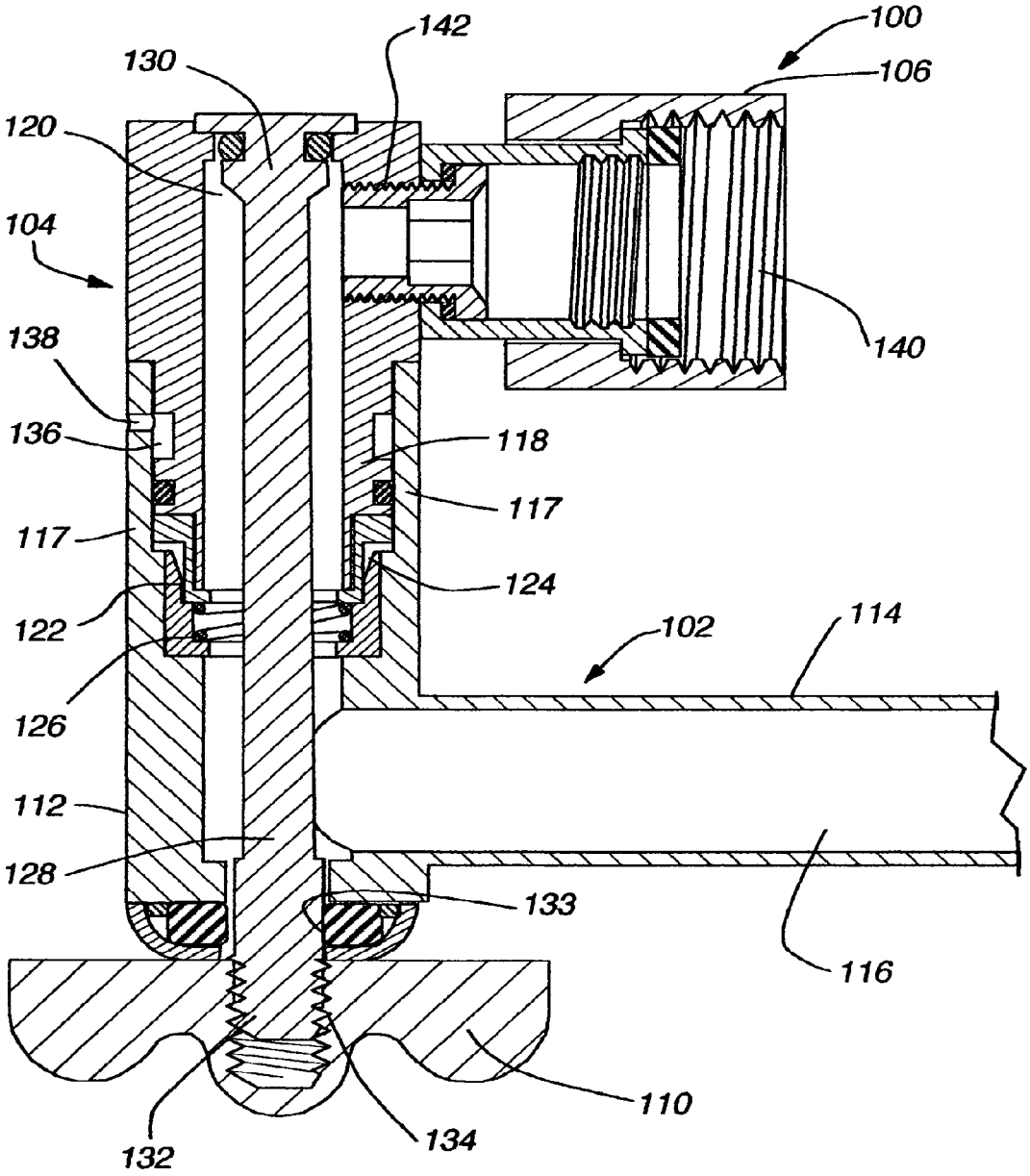
FIG. 2 depicts a cross-sectional view of the shower arm of FIG. 1 when the arm portion is in a locked state.

The structure of the articulating shower arm 100 of FIG. 1 is shown in detail in the cross-sectional view of FIG. 2 with the shower arm 100 in a stable, locked state. In the present embodiment and as shown, the angular position of the arm portion 102 cannot be changed with respect to the water supply connector 106, thus providing a secure mounting for a shower head attached to the shower head connector 108 (not shown in FIG. 2). Alternate embodiments may permit adjustment of the angle between the arm portion 102 and the elbow portion 104 and/or the shower head connector 108 to enhance positioning of the shower head.

The arm portion 102 includes an elbow receiving end 112 formed at a right angle to an extension section 114. The extension section 114 defines the long axis of the arm portion 102. Those in the art will appreciate, however, that the extension section 114 and the elbow receiving end 112 may form other angles while still remaining within the spirit and scope of the invention.

As can be seen in FIG. 2, the length of the arm portion 102 defines an arm channel 116 through which water may flow from the receiving end 112 (i.e., the end proximate the elbow portion 104) to a shower head connector end (not shown in FIG. 2) (i.e., the end closest to the shower head connector 108). As the term indicates, the elbow-receiving end 112 is adapted, typically by way of a hollow or recess, to receive an insertion end 118 of the elbow portion 104. As shown in FIG. 2, this hollow may be defined by one or more sidewalls 117 extending at an angle from the extension section 114. Likewise, the elbow portion 104 defines an elbow channel 120 within the elbow portion 104, running from the insertion end 118 to the water supply connector 106 of the elbow portion 104. Together, the arm channel 116 and the elbow channel 120 form a continuous channel through which water may flow from the interior of the water supply connector 106 to the shower head connector 108.

Figure 4:
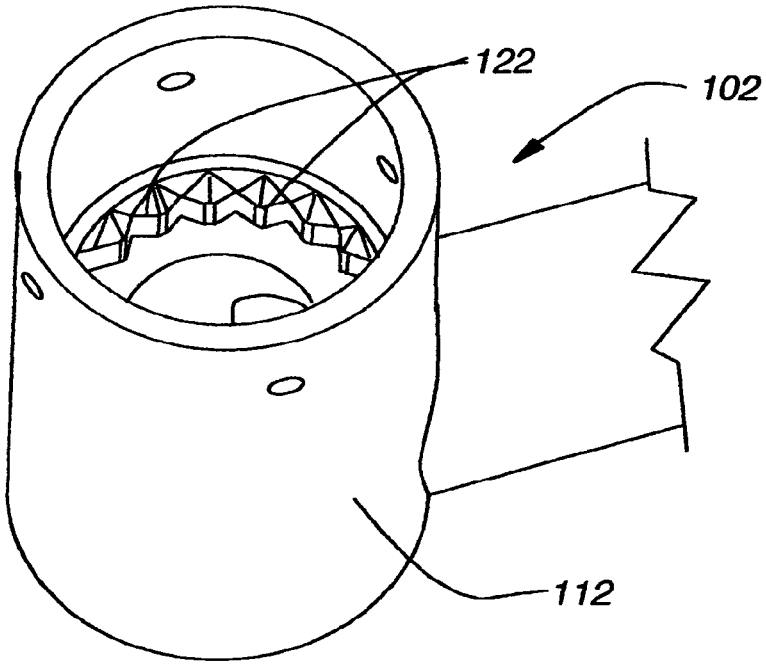
FIG. 4 depicts a perspective view of the arm portion of FIG. 1 showing a set of splines.

To facilitate a stable and pivotable connection between the arm portion 102 and the elbow portion 104, a set of elbow splines 124 residing on the external surface of the insertion end 118 of the elbow portion 104 mesh with a complementary set of arm splines 122 within the receiving end 112 of the arm portion 102. Shown to best effect in FIG. 4, the complementary set of arm splines 122 in the arm portion 102 forms a multi-ridged surface. The set of elbow splines 124 residing in the elbow portion 104 define a complementary shape (not shown in FIG. 4). Referring again to FIG. 2, when the insertion end 118 of the elbow portion 104 resides inside the receiving end 112 of the arm portion 102, the two sets of splines 122, 124 engage. The interaction of the sets of splines 122, 124 cause the arm portion 102 to be held substantially immovable relative to the elbow portion 104. Conversely, when the insertion end 118 is partially removed from the receiving end 112 of the arm portion 102, the sets of splines 122, 124 are no longer engaged. Thus, the arm portion 102 is free to rotate about the long axis of the elbow portion 104.

To maintain the splines 122, 124 in the engaged position, as well as allow controlled disengagement of the sets of splines 122, 124 and allow the aforementioned pivoting, the embodiment employs a compression spring 126, adjustment post 128, and wing nut 110. More specifically, a stud end 130 of the adjustment post 128 is attached at the end of elbow portion 104 (near the shower head connector 108), and extends within the elbow channel 120. The opposing threaded end 132 of the adjustment post 128 extends beyond the insertion end 118 of the elbow portion 104, into the receiving end 112 of the arm portion 102, and out through a hole 133 formed in the arm portion 102. The threaded end 132 of the adjustment post 128 is configured to receive a mating threaded portion 134 of the wing nut 110.

Additionally, aligned with the long axis of the elbow portion 104 is the compression spring 126, which is also adjacent the insertion end 118 of the elbow portion 104 and within the extended sidewall 117 of the receiving end 112. The compression spring 126 applies a separation force between the insertion end 118 of the elbow portion 104 and the arm portion 102.

To engage the two sets of splines 122, 124, the wing nut 110 is tightened onto the threaded end 132 of the adjustment post 128, thus bringing the insertion end 118 of the elbow portion 104 further into the receiving end 112 of the arm portion 102 while compressing the spring 126. As mentioned above, once the sets of splines 122, 124 are engaged, the arm portion 102 is prevented from pivoting about the long axis of the elbow portion 104, resulting in a stable configuration for the shower arm 100.

Figure 3:
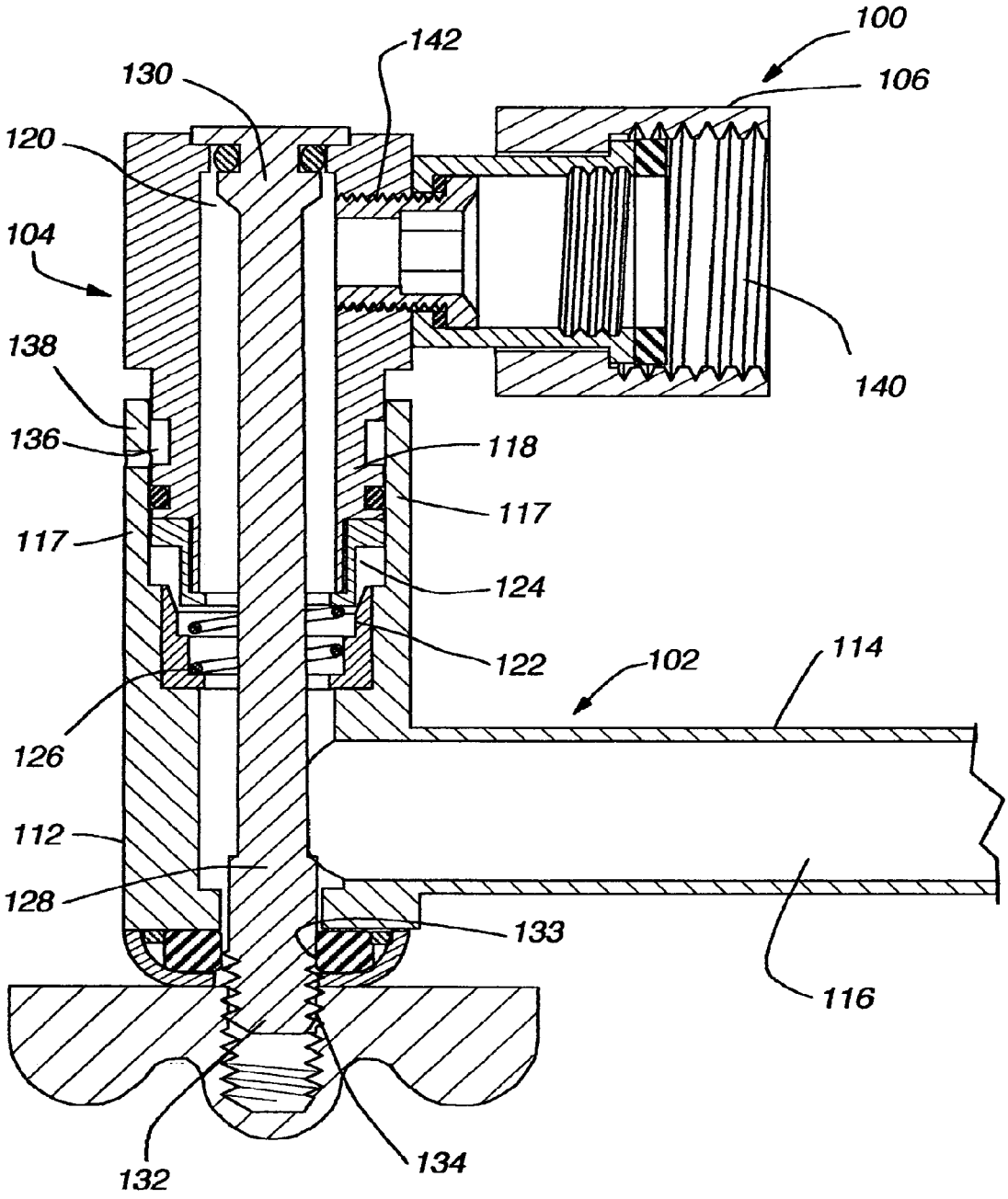
FIG. 3 depicts a cross-sectional view of the shower arm of FIG. 1 when the arm portion is in a pivotable state.

To permit pivoting, the wing nut 110 may be loosened from the adjustment post 128, thus allowing the compression spring 126 to bias the insertion end 118 of the elbow portion 104 further out of the recess of the receiving end 112 of the arm portion 102. This movement allows the two sets of splines 122, 124 to disengage, as shown in FIG. 3, in turn permitting the arm portion 102 to rotate about the long axis of the elbow portion 104. Tightening the wing nut 110 reengages the splines 122, 124, locking the arm portion 102 in place. Therefore, by operation of the wing nut, a user of the shower arm 100 may selectively lock and pivot the arm portion 102 at any of the several positions about the long axis of the elbow portion 104 assumable by the interlocking splines 122, 124.

Additionally, retention features may be formed in the elbow portion 104 and the arm portion 102, as shown in FIGS. 2 and 3, to ensure that the arm portion 102 and the elbow portion 104 remain coupled in the event the wing nut 110 is removed completely from the adjustment post 128. In the specific embodiment shown in FIG. 2, the elbow portion 104 defines a retention groove 136, and the arm portion 102 has a hole 138 through which a set screw (not shown in FIG. 2 or 3) may be driven. The retention groove 136 is sufficiently wide to allow the end of the set screw to reside in the groove 136 when the two sets of splines 122, 124 are either engaged or disengaged. Those of skill in the pertinent art will recognize that while a set screw arrangement is discussed herein, other suitable arrangements involving various retainers (such as a snap ring, for example) may also be employed while remaining within the spirit and scope of the invention.

In order to promote watertight operation for the shower arm 100, o-rings, gaskets, or similar structures (not shown in FIGS. 1, 2 and 3) may also be employed at various locations within the shower arm 100. For example, the hole defined by the arm portion 102 through which the adjustment post 128 extends may be supplemented with an o-ring to fill any void between the hole and the adjustment post 128. Other locations where such structures may be placed include, for example, the interface between the stud end 130 of the adjustment post 128 and the elbow portion 104, between the wing nut 110 and the adjustment post 128, and the interface between the elbow portion 104 and the arm portion 102. Such structures may not be required, however, depending on the amount of internal water pressure applied to the shower arm 100, the specific materials used in creating the shower arm 100 or its components, the inclusion of a hose or other channeling element within the flow channel defined by the arm portion 102 and the elbow portion 104, and so forth.

Regarding the connection of the shower arm 100 with a water supply pipe, the water supply connector 106 typically comprises an open end with internal screw threads 140 for receiving a threaded water supply pipe to form a watertight connection when water flows through the shower arm 100 via the water supply pipe. However, depending on the particular application for which the shower arm 100 will be employed, any other suitable structure for connecting a shower arm 100 to a water supply may be utilized. An o-ring or other seal may be included to facilitate watertight connection.

In the specific embodiment of FIGS. 2 and 3, the water supply connector 106 also contains external threads 142 which mate with a set of internal threads of the elbow portion 104, so the water supply connector 106 may be secured in the elbow portion 104 and create a watertight connection. In addition, those persons of ordinary skill in the art will appreciate that other suitable methods of providing such a connection may be employed. Further, the water supply connector 106 may be integrated with the elbow portion 104 to form a single continuous member. The same is also true of the shower head connector 108 and the arm portion 102.

In fact, any two members of the shower arm 100 that are to be intercoupled (including the arm portion 102 and the elbow portion 104) may be affixed to one another by way of a number of suitable configurations to effectively form a unitary element that prevents decoupling of the members. For example, a ramp and detent structure, such that by engaging the ramp of one member with a detent of another until the detent provides an interference with the back of the ramp, would be an example of one such configuration.

Figure 5:
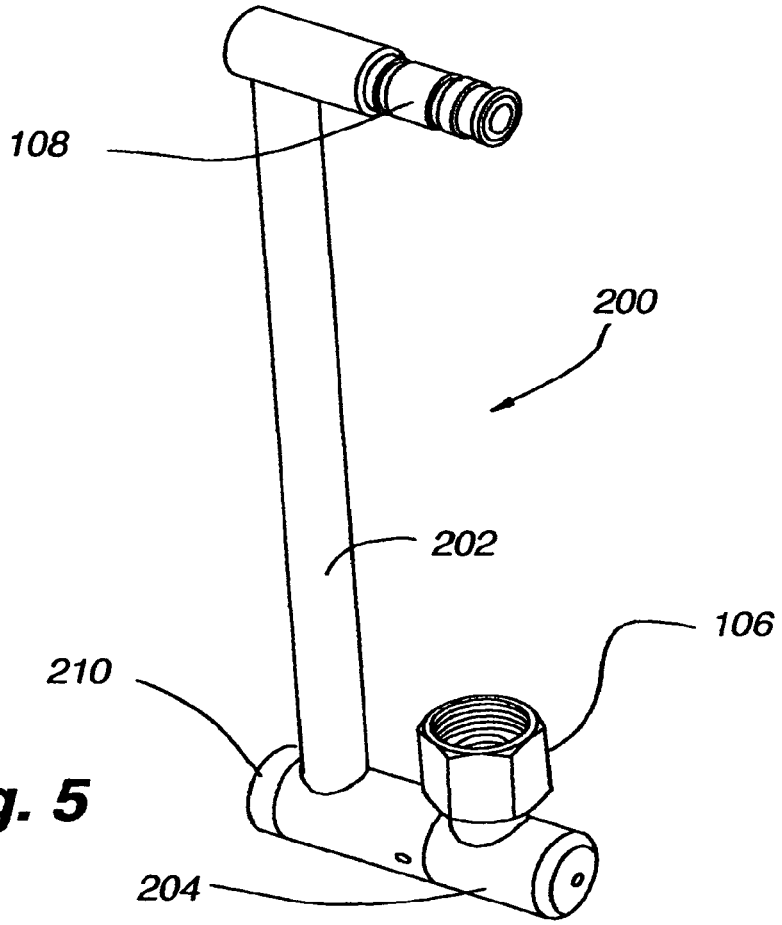
FIG. 5 depicts a perspective view of a shower arm according to a second embodiment of the present invention, employing a push button.

A second embodiment of an articulating shower arm 200 is shown in perspective view in FIG. 5. Instead of employing a wing nut 110, this shower arm 200 includes a push button 210 allowing a user to pivot an arm portion 202 of the shower arm 200 relative to the long axis of an elbow portion 204. As with the embodiment 100 shown in FIGS. 1-3, the shower arm 200 includes a shower head connector 108, while the elbow portion 204 has a water supply connector 106.

Figure 6:
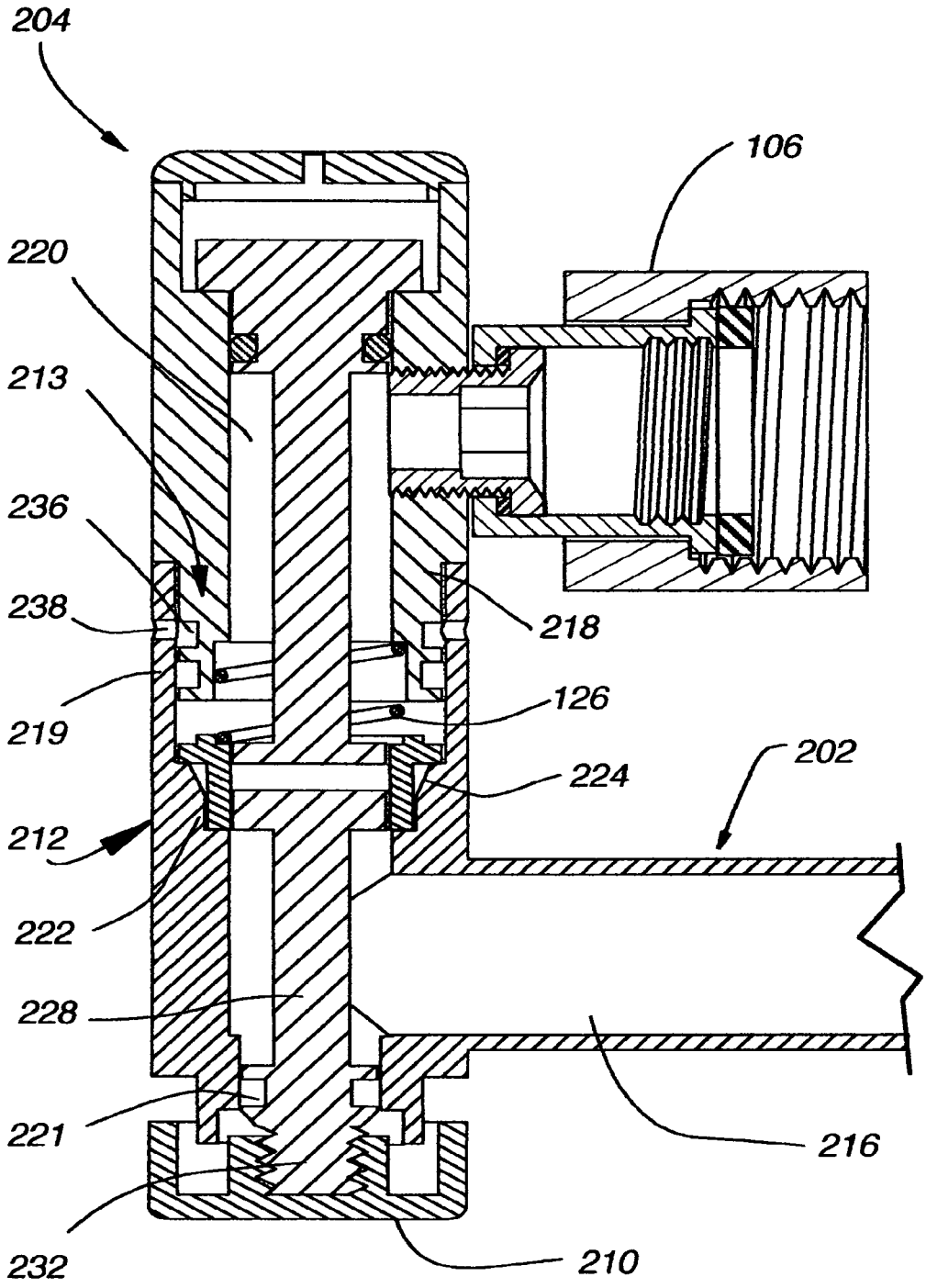
FIG. 6 depicts a cross-sectional view of the shower arm of FIG. 5 when the arm portion is in a locked state.
Figure 7:
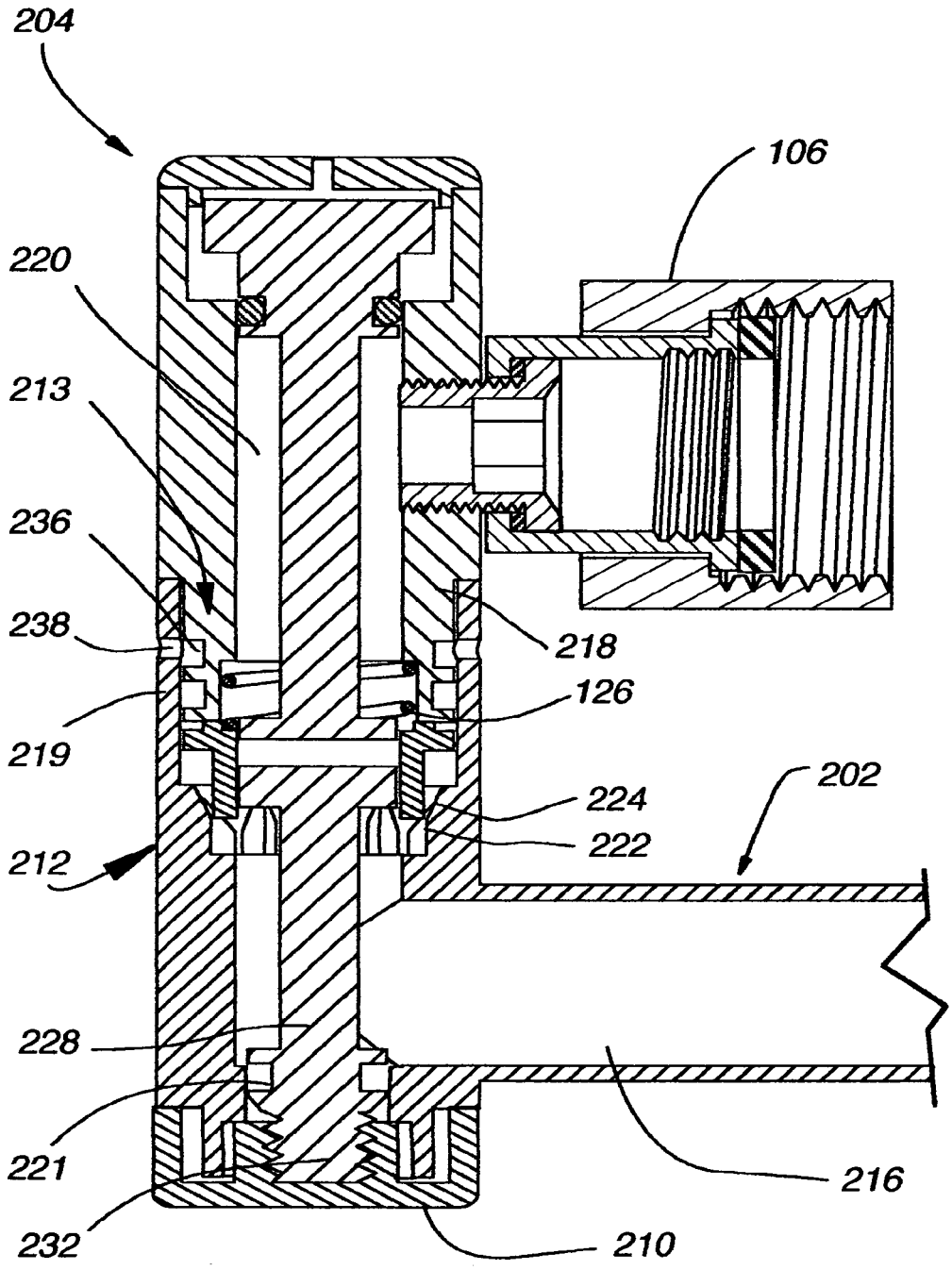
FIG. 7 depicts a cross-sectional view of the shower arm of FIG. 5 when the arm portion is in a pivotable state.

As shown in the cross-section views of FIGS. 6 and 7, the arm portion 202 defines a receiving end 212 with a recess 213 in which an insertion end 218 of the elbow portion 204 is located. Recess 213 is defined by one or more sidewalls 219. As in the previously discussed embodiment 110, the arm portion 202 defines an arm channel 216 and the elbow portion 204 defines an elbow channel 220. These two channels 216, 220 collectively form a continuous channel linking the water supply connector 106 and the shower head connector 108. A hose or other watertight and/or channeling element may be disposed within this continuous channel.

The shower arm 200 of FIGS. 6 and 7 may also include an adjustment post 228. The adjustment post 228 has one end residing within the elbow channel 218, extends through the insertion end 218 of the elbow portion 204, into the receiving end 212 of the arm portion 202, and through a hole 221 defined in the end of the arm portion 202. As shown in FIGS. 6 and 7, the push button 210 is attached to a threaded end 232 of the adjustment post 228. However, any means of fixably attaching the push button 210 to an end of the adjustment post 228 may be employed, such as an adhesive, sonic welding, heat sealing, and the like.

Figure 8:
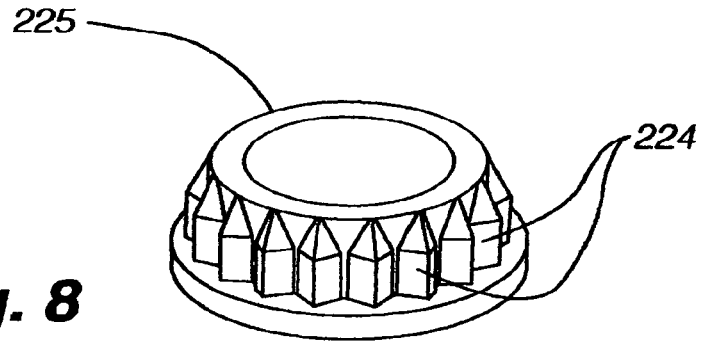
FIG. 8 depicts a perspective view of the set of splines of the embodiments of FIGS. 1 and 5.

In this particular embodiment, a set of post splines 224 is affixed to the exterior of the long axis of the adjustment post 228, while a complementary set of arm splines 222 is attached to an interior of the recess of the receiving end 212 of the arm portion 202. As shown in FIG. 8, the set of post splines 224 associated with the adjustment post 228 may be disposed about a ring 225 securely coupled with the adjustment post 228. In alternate embodiments, the set of post splines 224 may be integrated with the adjustment post 228 as a single member. The same integration may also occur in conjunction with the arm splines 222 and the interior of the receiving end 212 of the arm portion 202. Additionally, the set of post splines 224 shown in FIG. 8 are substantially identical to the set of arm splines 222 of the present embodiment, as well as the set of arm splines 122 and set of elbow splines 124 employed in the shower arm 100 of FIGS. 1-3.

The compression spring 126 of the present embodiment is located within the insertion end 218 of the elbow portion 204, and supplies a force between the insertion end 218 and the adjustment post 228 so that the two sets of splines 222, 224 remain engaged.

Additionally, to prevent the elbow portion 204 and the arm portion 202 from separating under the force of the compression spring 126, a retention structure similar to that described above is utilized. In the present embodiment, a groove 236 is formed on the outer surface of the insertion end 218, and a hole 238 is provided in the receiving end 212 of the arm portion 202. The groove 236 and the hole 238 may be used in conjunction with a set screw (not shown) to couple the elbow portion 204 and the arm portion 202. In that case, the set screw would be driven into the hole 238 to mate with the groove 236, thus holding the arm portion 202 and the elbow portion 204 together. Other retention methods, as described above, may also be possible.

When the push button 210 of the shower arm 200 is not depressed (as shown in FIG. 6), the compression spring 126 biases the adjustment post 228 along the long axis of the elbow portion 204 toward the arm portion 202. In this position, the two sets of splines 222, 224 are engaged, thus substantially prohibiting any pivoting of the arm portion 202 about the long axis of the elbow portion 204.

However, when a user depresses the push button 210 (i.e., drive the button toward the arm portion 202 to occupy the position shown in FIG. 7), the adjustment post 228 is forced along its axis toward the elbow portion 204, thus compressing the compression spring 126. The movement of the adjustment post 228 causes the set of splines 222, 224 to move accordingly and disengage. As a result, the arm portion 202 may pivot freely about the long axis of the elbow portion 204 while the push button 210 is depressed. Once the push button 210 is released, the sets of splines 222, 224 reengage, and further pivoting is prohibited.

Further, the elbow portion 204 typically does not decouple from the arm portion 202 when the push button 210 is depressed. In other words, the insertion end 218 of the elbow portion 204 does not partially withdraw from the recess 213 defined in the arm portion 202 in order for the sets of splines 222, 224 to disengage, as can be seen in FIG. 7. Accordingly, the groove 236 (defined on the surface of the insertion end 218 of the elbow portion 204) need not be sized to permit translation of the insertion end 218 within the arm portion 202. By contrast, the groove 136 in the embodiment 100, discussed above with respect to FIG. 3, is sized to facilitate partial withdrawal of the elbow portion 104 from the arm portion 102 when the wing nut 110 is loosened. In another embodiment of the present invention, the locations of the compression spring 126 and the sets of splines 222, 224 within the articulating shower arm 200 may be swapped, resulting in the button 210 being operated by pulling instead of pushing. More specifically, the compression spring 126 operates in this embodiment to force the adjustment post 228 and the button 210 toward elbow portion 204, thus causing the two sets of splines 222, 224 to engage, thereby locking the relative position of the arm portion 202 and the elbow portion 204. To allow the arm portion 202 to rotate freely about the elbow portion 204, the user pulls the button 210 away from the arm portion 202, thus disengaging the sets of splines 222, 224. Once the arm portion 202 is rotated about the elbow portion 204 to a desired position, the user then releases the button 210, which allows the compression spring 126 to pull the adjustment post 228 further into the articulating arm 200, thereby allowing the sets of splines 222, 224 to reengage, thus locking the position of the arm portion 202 relative to the elbow portion 204.

Figure 9:
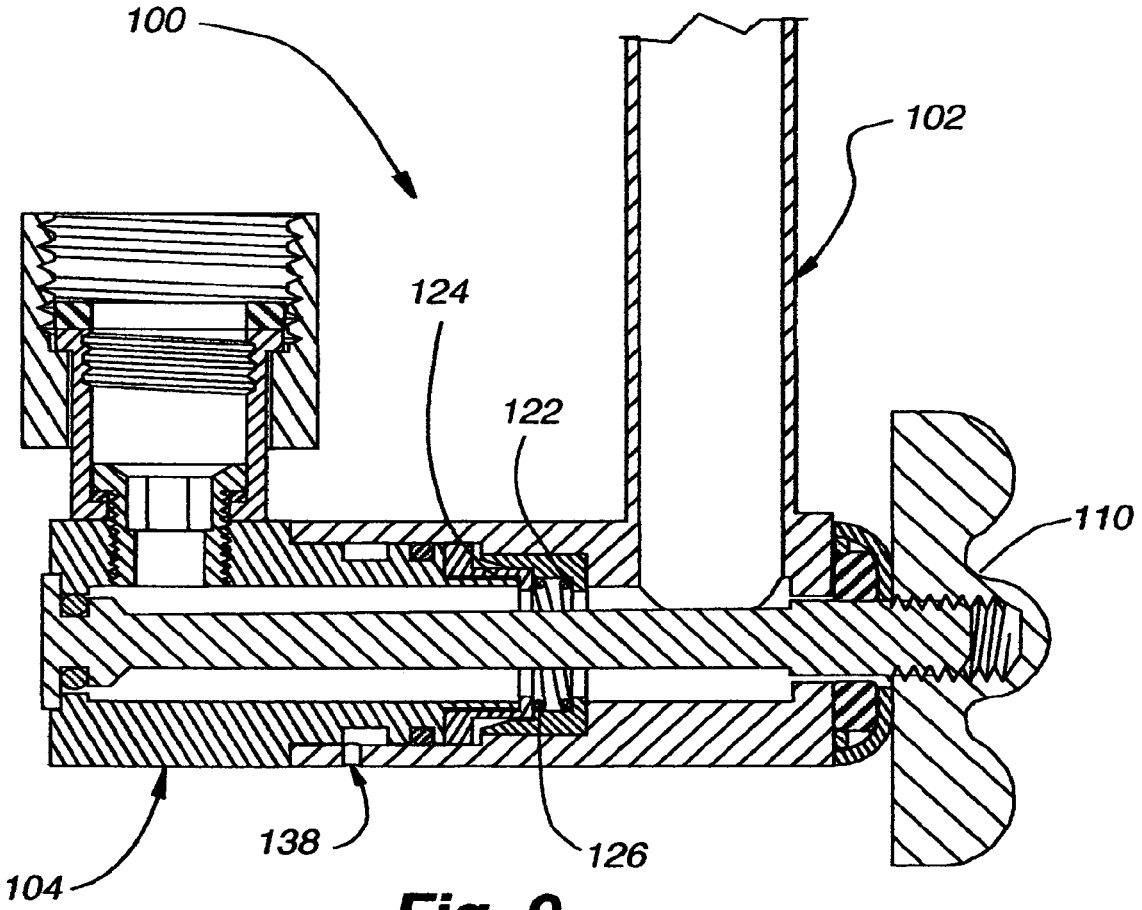
FIG. 9 depicts an annotated cross-sectional view of the shower arm of FIG. 1.
Figure 10:
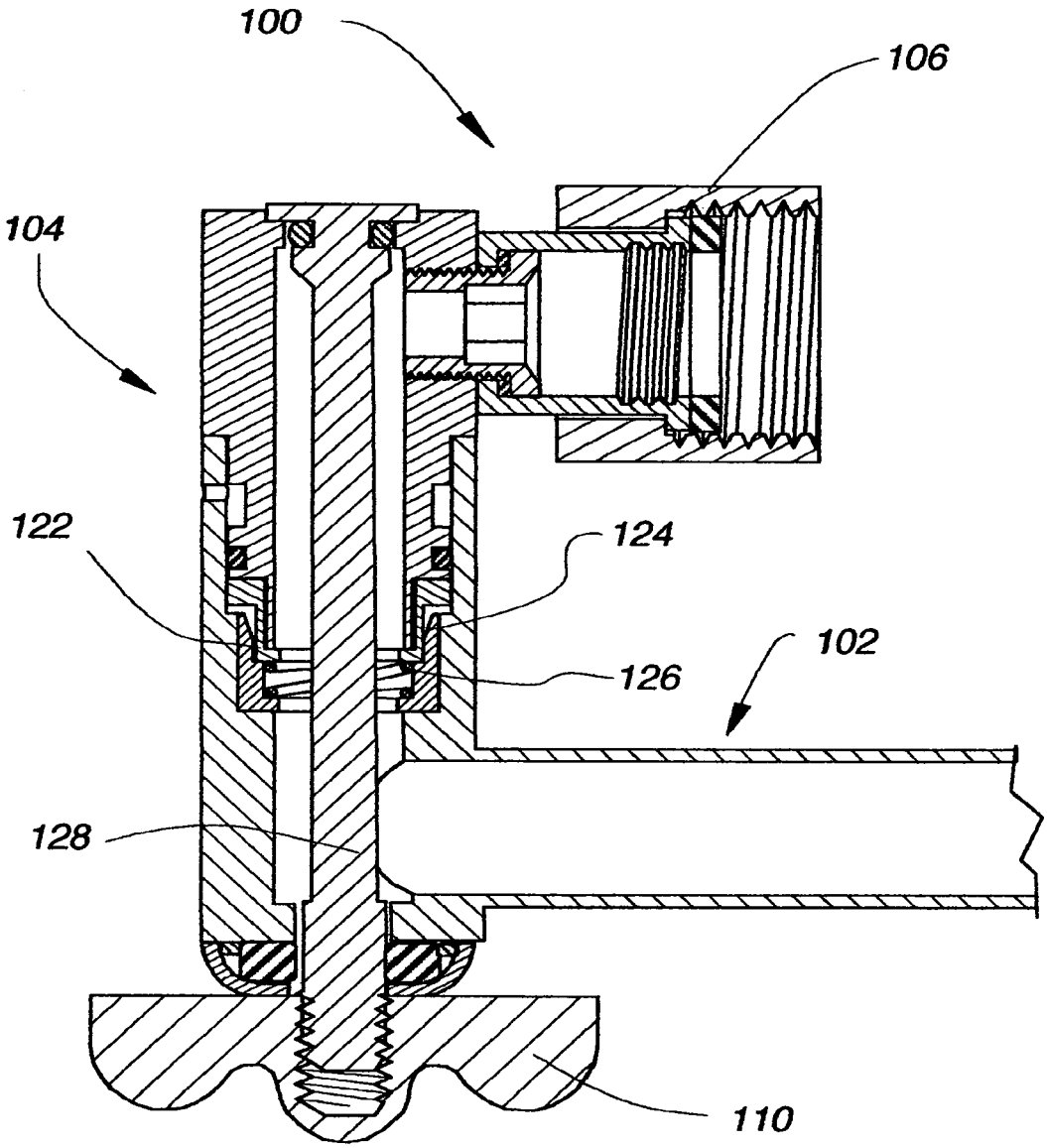
FIG. 10 depicts a shaded cross-sectional view of the shower arm of FIG. 1 when the arm portion is in a locked state.
Figure 11:
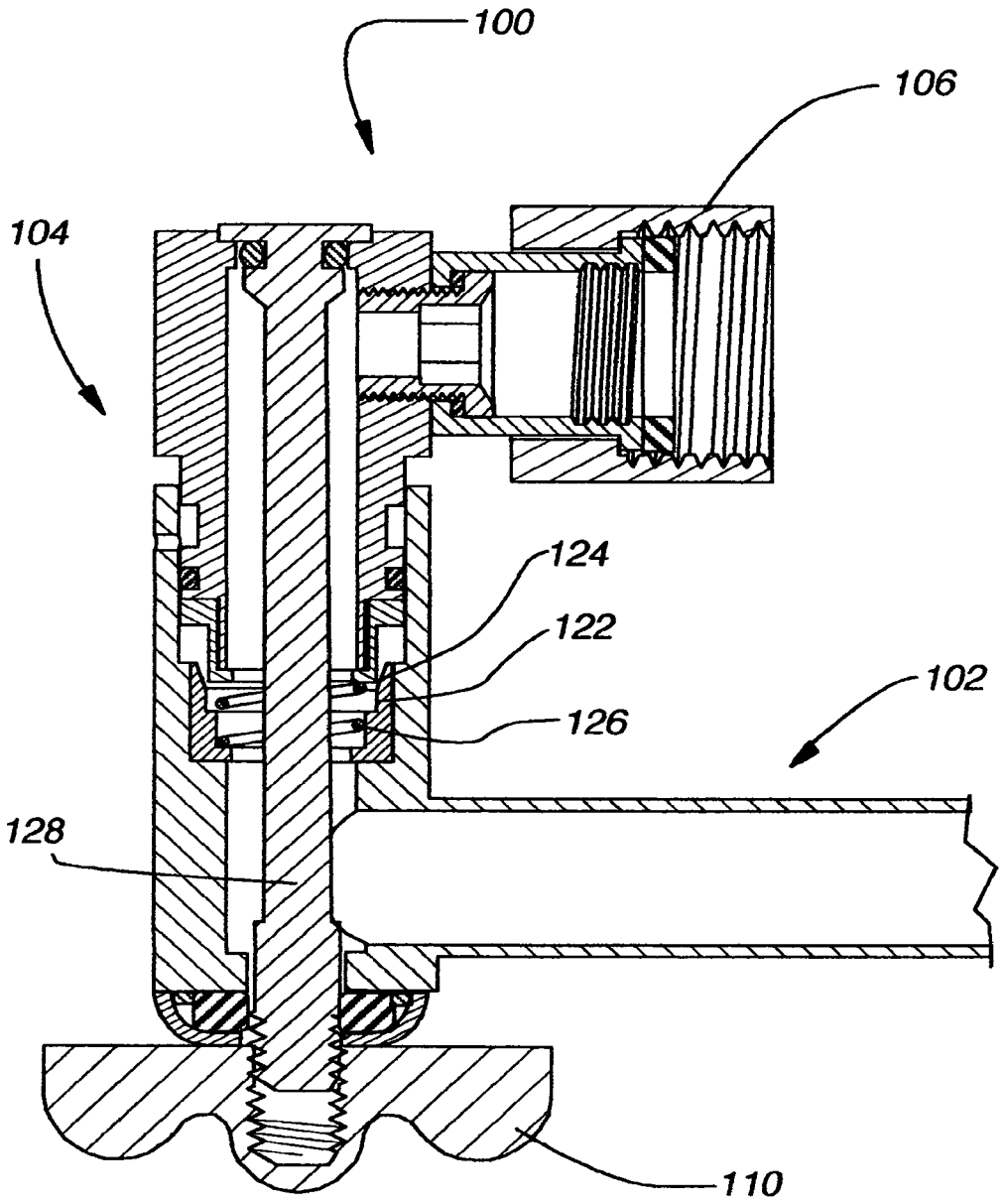
FIG. 11 depicts a shaded cross-sectional view of the shower arm of FIG. 1 when the arm portion is in an unlocked state.
Figure 12:
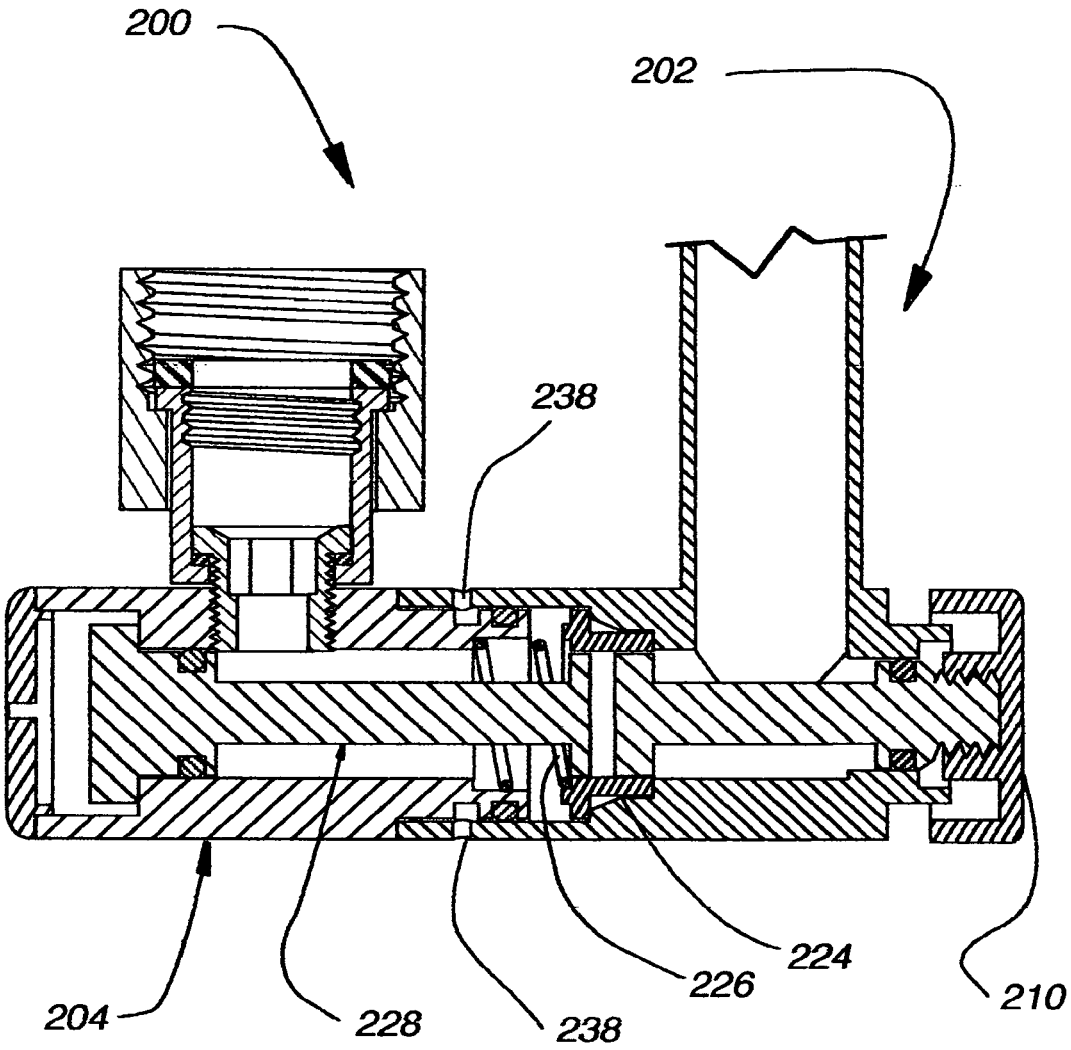
FIG. 12 depicts an annotated cross-sectional view of the shower arm of FIG. 5.
Figure 13:
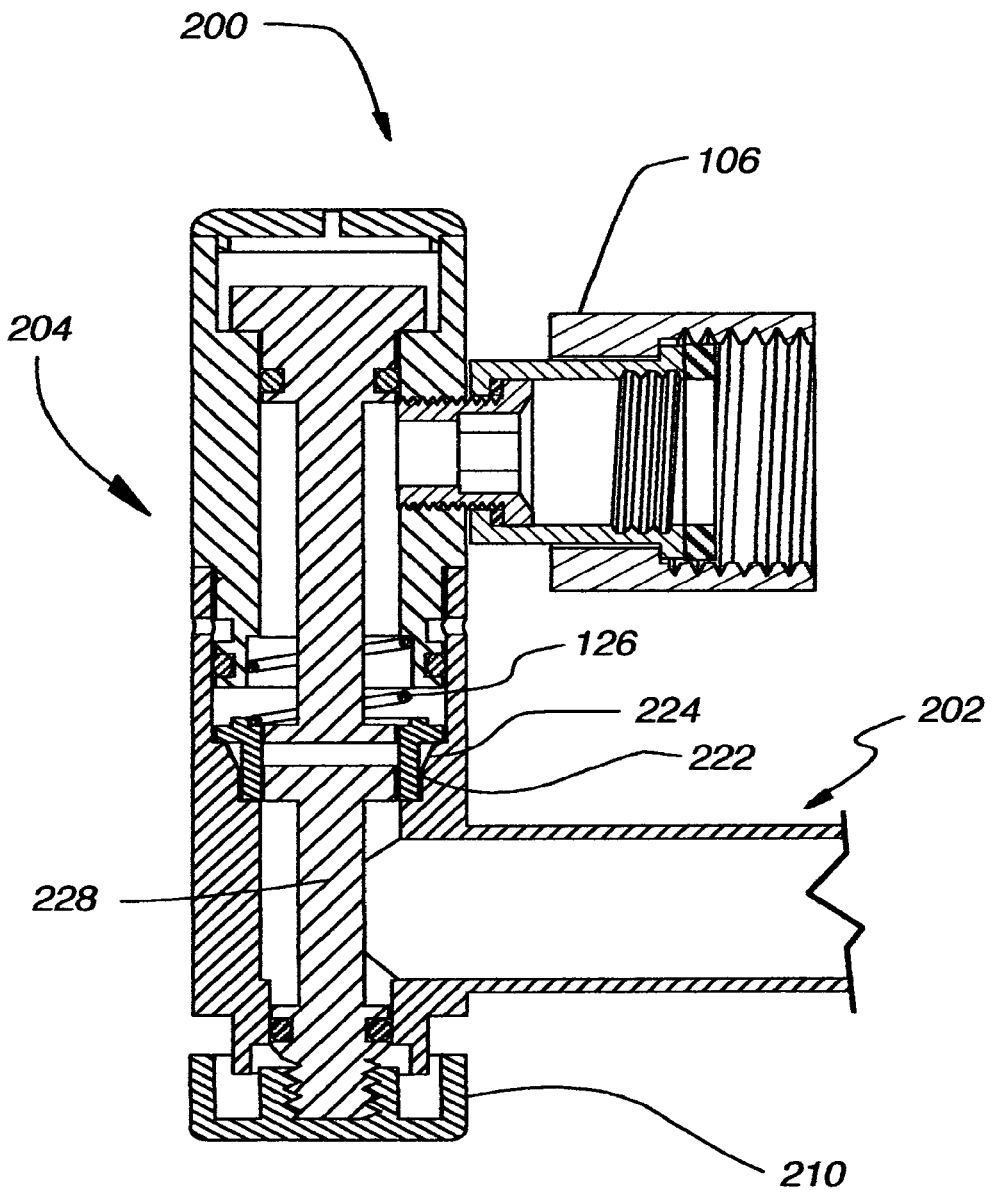
FIG. 13 depicts a shaded cross-sectional view of the shower arm of FIG. 5 when the arm portion is in a locked state.
Figure 14:
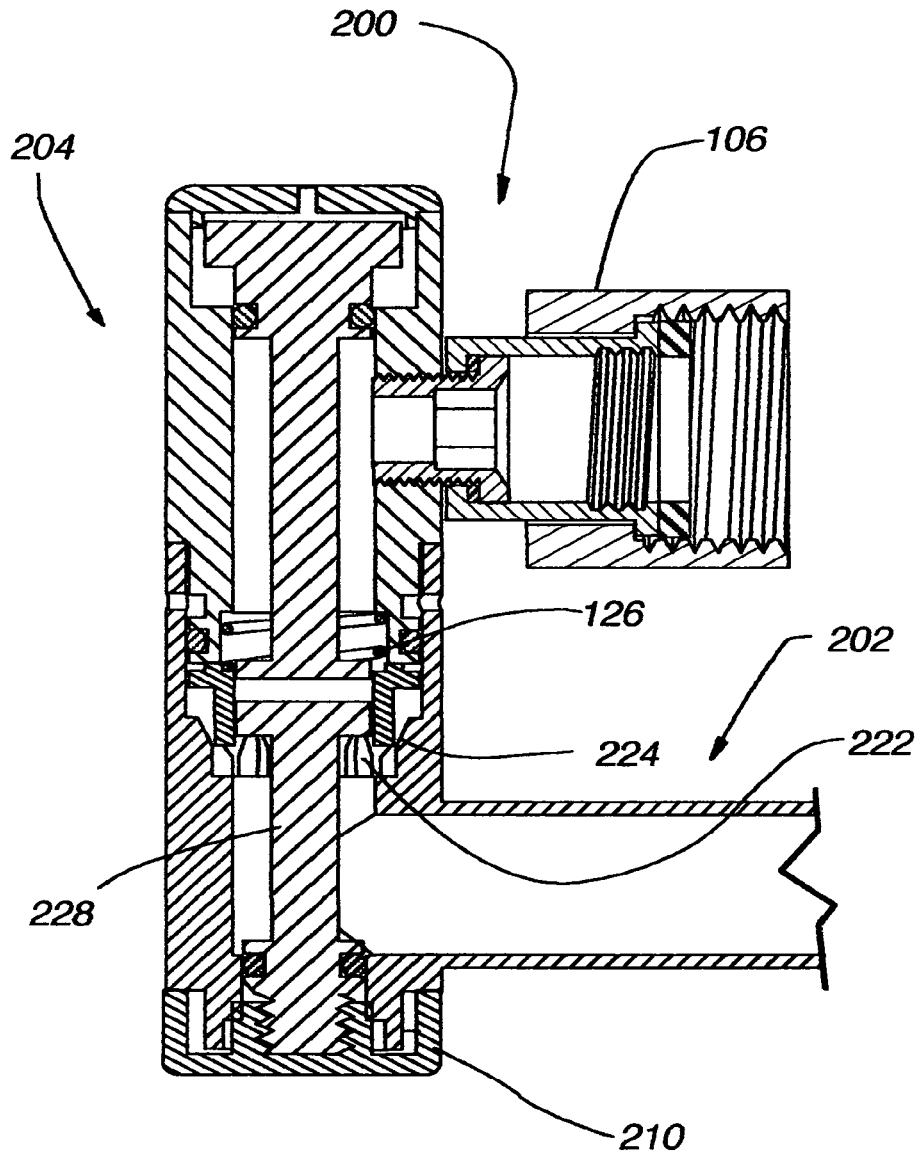
FIG. 14 depicts a shaded cross-sectional view of the shower arm of FIG. 5 when the arm portion is in an unlocked state.

In further exposition of the disclosed embodiments of the invention, FIGS. 9-11 depict cross-sectional views of the shower arm 100 of FIGS. 1-4. Similarly, FIGS. 12-14 depict cross-sectional views of the shower arm 200 of FIGS. 5-8.

Alternative embodiments of the present invention may employ additional articulating arm structures. Specifically, alternative embodiments may employ different locking mechanisms for selectively permitting or inhibiting rotation of the arm portion with respect to the elbow portion, or vice versa. Several of these mechanisms are described with reference to FIGS. 17-25, below.

Figure 17:
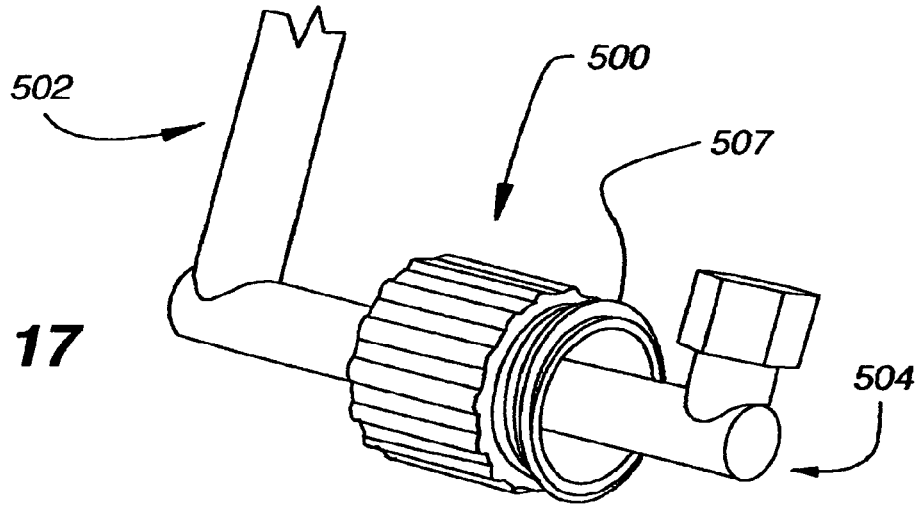
FIG. 17 depicts an isometric view of an articulating arm employing a nut-and-collet structure.

FIG. 17 depicts another embodiment of the present invention, this one employing a nut-and-collet structure 500. The elbow portion 504 is L-shaped, and a segment of the elbow portion 504 is received within a section of the L-shaped arm portion 502. This is shown to best effect in the cross-sectional view of FIG. 18.

Figure 18:
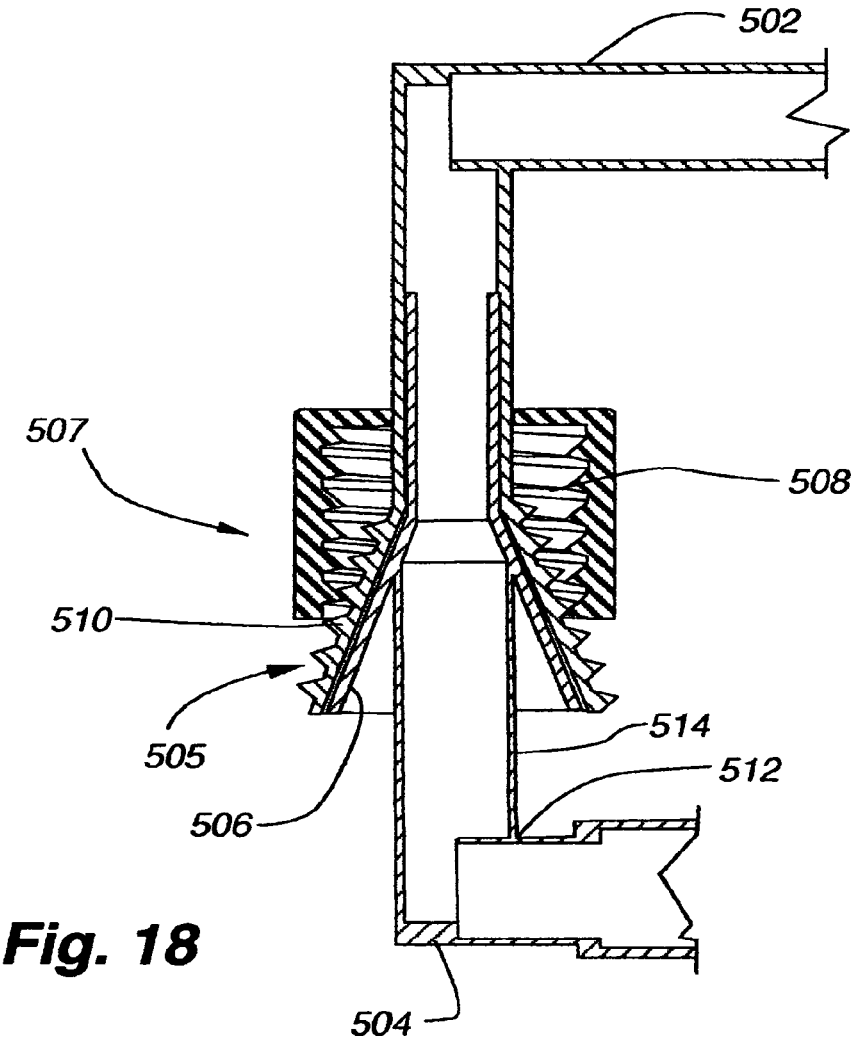
FIG. 18 depicts a cross-sectional view of the articulating arm and nut-and-collet structure of FIG. 17.

Still with respect to FIG. 18, in the present embodiment the collet 505 takes the form of a frustoconical, threaded cylinder open at both ends. The collet 505 may be a separate piece, or may be formed integrally with the arm portion 502. In either event, the collet 505 is generally securely affixed to the arm portion. The collet surrounds a shaft 506, which is also frustoconical. The shaft is typically formed integrally with the elbow portion, as shown, but may also be separately formed and later attached thereto. Neither the collet 505 nor shaft 506 interfere nor prohibit fluid or solids from passing through either the elbow or arm portions.

A nut 507 at least partially surrounds the collet, as shown in FIG. 18. The nut 507 is internally threaded 508 to mate with the collet's external threads 510. The nut may also partially surround a cylindrical segment of the arm potion. As the nut is rotated, the nut threads 508 advance the relative position of the nut along the collet 506 towards the perpendicular joint 512 in the elbow portion 504. This in turn compresses the shaft against the elbow portion. The frictional force between the collet and shaft holds the elbow portion stationary relative to the arm portion, thus preventing rotation. When the nut 507 is loosened (i.e., rotated such that the nut body moves backward towards the arm portion), the collet 505 and shaft 506 may expand, lessening frictional force therebetween and permitting the elbow and arm portions to rotate with respect to one another.

The angle between shaft 506 and segment 514 of the elbow portion mating with the arm portion may vary in alternative embodiments. Similarly, the angle between collet and segment of the arm portion mating with the elbow portion may also vary. Typically the collet and shaft are parallel. In any embodiment, however, the angle between shaft and mating elbow segment (or collet and mating arm segment) is such that the force generated by tightening the nut about the collet does not cause the elbow portion to move away from or disconnect from the arm portion.

Figure 19:
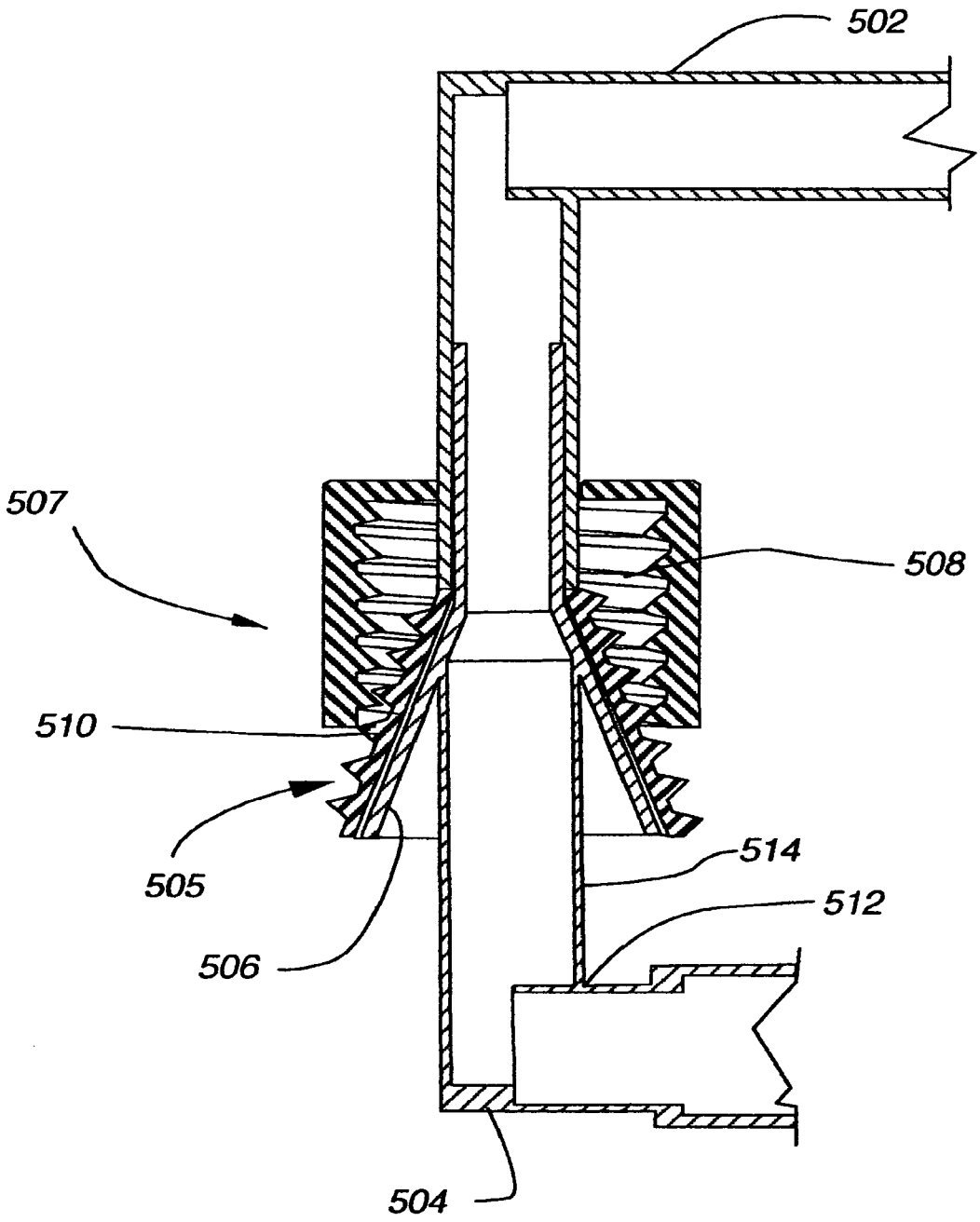
FIG. 19 depicts another cross-sectional view of the articulating arm and nut-and-collet structure of FIG. 17.

FIG. 19 depicts another cross-sectional view of an articulated arm embodiment employing a nut-and-collet structure.

Figure 20:
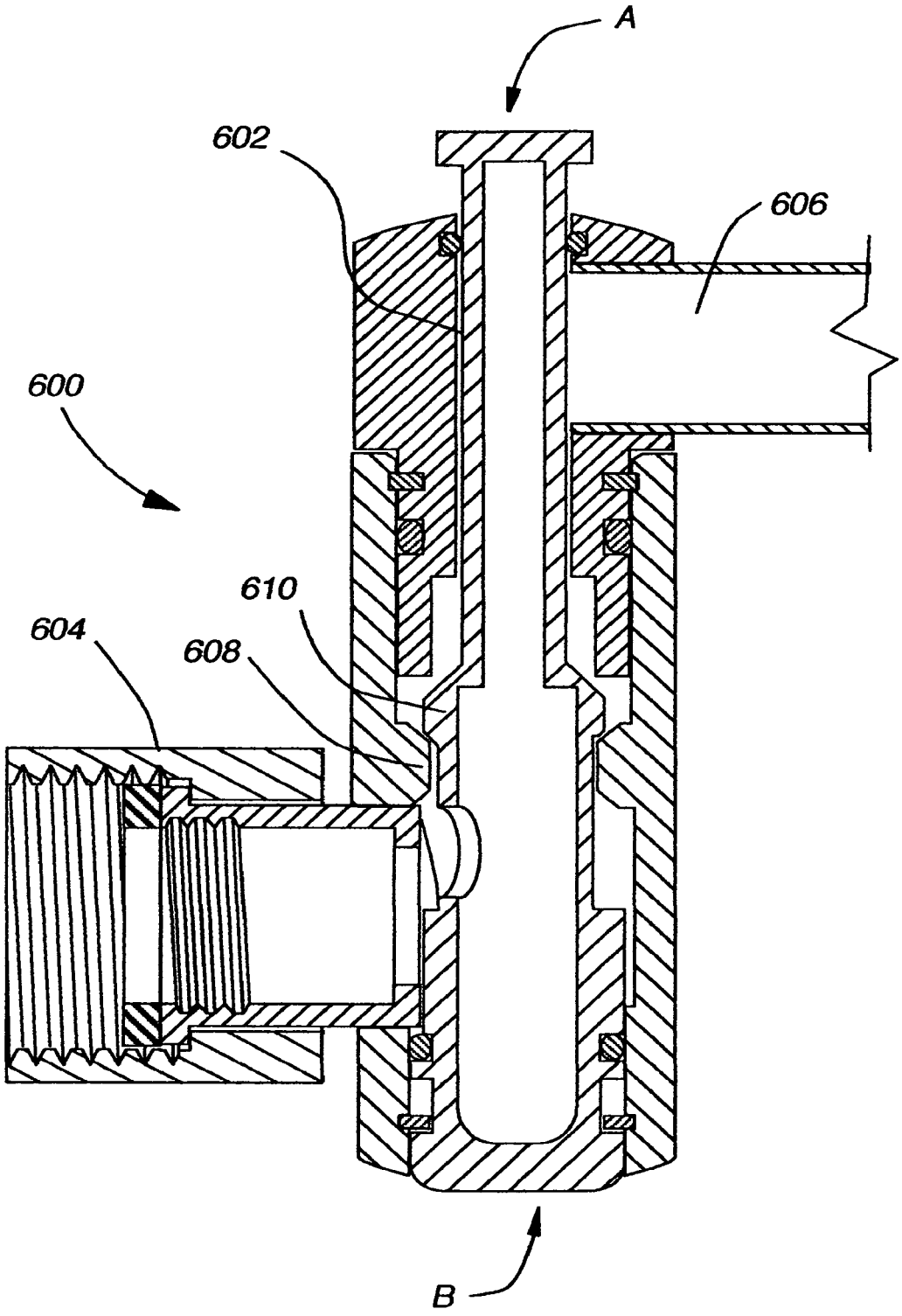
FIG. 20 depicts a cross-sectional view of an articulating arm employing an opposing push-pull structure.

FIG. 20 depicts a cross-sectional view of yet another articulated arm embodiment 600. This particular embodiment employs a slider 602 to lock or unlock the elbow 604 and arm portions 606. As described above, both the elbow 604 and arm 606 portions are generally L-shaped, with one of the "L" segments of the elbow portion (the "elbow mating segment") receiving one of the "L" segments of the arm portion (the "arm mating segment"). In some embodiments, the arm mating segment may receive the elbow mating segment.

A slider runs the length of the elbow and arm mating segments, and is either flush or projects outwardly from opposing ends of these segments, as shown in FIG. 20. In the present embodiment, the elbow portion includes a set of splines ("female splines") 608 arranged circumferentially about the hollow interior. The slider 602 includes a set of splines ("male splines") 610 positioned circumferentially about the slider exterior, such that the male splines 610 nest within the female splines 605 when the slider 602 is in a first position and disengage from the female splines when the slider is in a second position. The slider may move from the first to second position by pushing or pulling on the part(s) of the slider projecting outwardly from the mating segments.

For example, FIG. 20 depicts the slider in a second position, with the male splines disengaged from the female splines. With the male and female sets of splines in this position, the elbow portion 604 may freely rotate with respect to the arm portion 606 (or vice versa).

Pressing the slider end marked "A", or pulling the slider end marked "B", moves the slider along the elbow and arm mating segments until the male splines 610 engage the female splines 608. When the splines engage, rotational motion between the elbow portion and slider is prevented. In the present embodiment, the slider 602 may include a detent structure mating with a recess in the arm portion when the splines engage, in order to couple the slider to the arm portion. Similarly, a protrusion may run along at least a portion of the slider and be received in a groove or recess defined in the arm portion sidewall to prevent the arm from rotating relative to the slider. In some embodiments, the slider 602 is coupled to the arm portion only when the male splines engage the female splines. In other embodiments, the slider and arm portions are continuously coupled, such that the slider and arm portions cannot rotate with respect to one another. In yet other embodiments, the arm portion may include the set of female splines rather than the elbow portion, and the slider may be coupled to the elbow portion. Further, a single spline may be received within a single groove, rather than employing multiple sets of splines, with the same result of locking out rotation of the arm portion with respect to the elbow portion.

Figure 21:
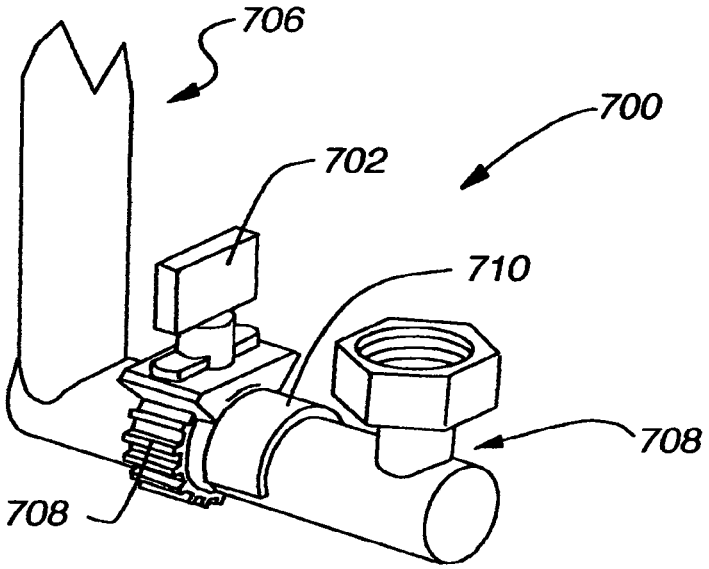
FIG. 21 depicts an isometric view of an articulating arm employing a gear and plunger tab.

FIG. 21 depicts an alternative embodiment of an articulating arm 700. This particular embodiment includes a plunger tab 702 and gear 704 cooperating to selectively permit or prevent rotation between the arm portion 706 and elbow portion 708. In this embodiment, the plunger tab 702 is affixed to the elbow portion by a clamp 710, while the gear 704 is affixed to the arm portion. The tab 702 and gear 704 may be affixed to their relative portions by a screw, bolt, strap, adhesive, sonic welding, thermal welding, or any other means known to those skilled in the art. Further, in some embodiments the plunger 702 may be affixed to the arm portion 706 while the gear 704 is affixed to the elbow portion 708.

The plunger tab 702 includes a tooth or projection (not shown), which nests between two gear teeth when the plunger is in a "rest" position, as shown in FIG. 21. By pulling the plunger upwardly, the projection unseats from the gear teeth and the plunger tub and gear are no longer rotationally coupled (not shown). Thus, the arm and elbow portions are similarly rotationally uncoupled, being free to turn with respect to one another. When the plunger tab is released, a spring or other resistive element biases the plunger projection into the gear, coming to rest between gear teeth.

Since the plunger tab 702 is affixed to one of either the arm or elbow portions and the gear is affixed to a second of either the arm or elbow portions, the arm and elbow portions are prevented from rotating when the plunger tab projection engages the gear teeth. Likewise, the arm and elbow portions are free to rotate respective to one another when the plunger tab projection is removed from the gear teeth.

Figure 22:
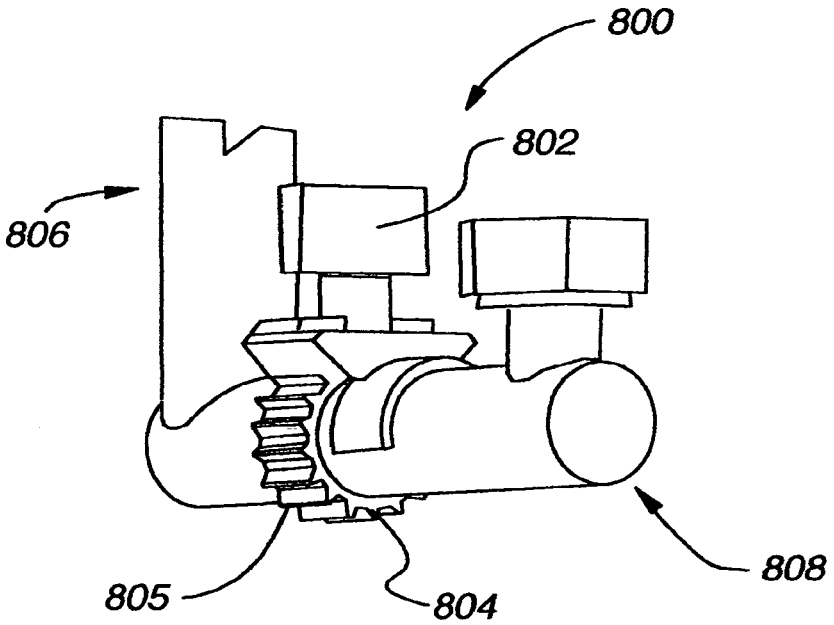
FIG. 22 depicts an isometric view of an articulating arm employing a ratchet and plunger tab.

FIG. 22 depicts yet another embodiment of an articulating arm 800. This embodiment employs a plunger tab 802 in a manner similar to that described with respect to the embodiment shown in FIG. 21. In this embodiment, however, the aforementioned gear is replaced with a ratchet 804. The ratchet 804 has multiple teeth 805, each of which extends radially outwardly from the ratchet surface on a first side and outwardly at an oblique angle to the ratchet surface on a second side. Thus, one side of each of the ratchet teeth forms a ramp-like structure. In this embodiment, the ratchet 804 is affixed to the arm portion 806 while the plunger tab 802 is affixed to the elbow portion 808. Again, this may be reversed in alternative embodiments.

The ramp-like structure of each ratchet tooth permits the plunger tab projection to move upwardly when the tab encounters the ramp. However, the radially extending side of each ratchet tooth prevents any upward motion by the plunger. Thus, when the arm portion and associated ratchet are turned in a clockwise direction (with reference to FIG. 22), the plunger tab projection slides upwardly along the ramp structure regardless of whether the tab itself is pulled upward. After the arm portion is sufficiently rotated, the plunger tab projection moves off the ramp structure and downwardly, again seating between ratchet teeth and holding the arm rotationally in place with respect to the elbow.

By contrast, however, the straight (i.e., radially outwardly extending) side of each ratchet tooth impacts the plunger tab 802 projection when the arm portion 806 moves in a counter-clockwise direction, thus minimizing rotational movement between the arm 806 and elbow portions 808. In this manner, the present embodiment may permit rotational motion in one direction while preventing rotational motion in an opposite direction.

It should be noted the ratchet 804 may be configured to permit rotational motion in either a clockwise or counter-clockwise direction (again, with respect to the view shown in FIG. 22). In some embodiments, both sides of the ratchet may form ramp-like structures, permitting selective rotational motion in either direction. In any embodiment employing a ratchet as described herein, the angle formed by the ramp-like structure with the circumference of the ratchet body is such that frictional force between ratchet and plunger, in addition to the biasing force within the plunger, prevent the plunger projection from sliding up and over a ramp without the application of external force.

Although the plunger tab 802 described with respect to FIGS. 21 and 22 has been disclosed as spring-biased tab, it should be noted that a toggle switch may be employed instead. The toggle switch typically would have no biasing force, instead locking into either the upward or downward positions. A rocker arm may also be used in place of the plunger tab.

Figure 23:
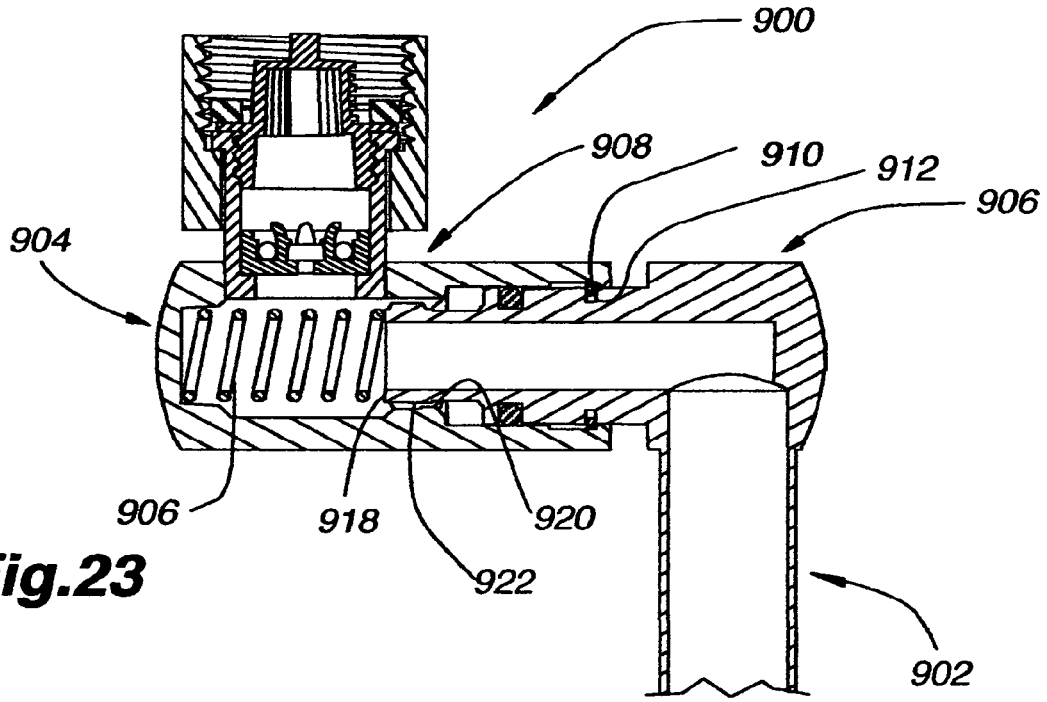
FIG. 23 depicts a cross-sectional view of an articulating arm employing a depressable arm portion.

FIG. 23 depicts yet another articulating arm embodiment 900 capable of selectively permitting or restraining rotational motion between an arm portion 902 and elbow portion 904. In this embodiment, the arm portion 902 includes an arm mating segment 906 at least partially received within an elbow mating segment 908 of the elbow portion. The elbow mating segment 908 and arm mating segment are hollow.

A retaining ring 910 sits at least partially within an arm annular groove 912 defined on the arm mating segment exterior. The retaining ring is compressible. A sloped annular ramp 914 is formed at the hollow opening of the elbow mating segment, with an annular channel defined in the interior of the elbow mating segment directly beneath the annular ramp. The annular ramp overhangs the annular channel.

When the arm mating segment 906 is inserted into the elbow mating segment 908, the retaining ring 910 slides along the annular ramp 914, compressing at least slightly. The arm annular groove 912 prevents the retaining ring from moving laterally along the arm mating portion. Once the retaining ring moves beyond the lip of the annular ramp, it expands into the annular channel defined in the elbow mating segment. The retaining ring 910 abuts the edge of the annular channel during operation of the embodiment, preventing the arm mating segment from disconnecting from the elbow mating segment.

A compression spring 916 is disposed within the elbow mating segment 908. The spring 916 abuts the end 918 of the arm mating segment received within the elbow mating segment exerting a force against the arm mating segment and biasing it outwardly, away from the elbow mating segment 908. In other words, the spring 916 generally exerts a decoupling force resisted by the retaining ring 910.

The elbow mating segment 908 and arm mating segment 906 each include a set of splines. When no external force is exerted against the articulating arm, the spring force interleaves the arm splines 920 with the elbow splines 922. When the splines are interleaved (i.e., mated), they cooperate to minimize rotational motion between the arm and elbow portions.

The arm and elbow splines may be decoupled by pressing the arm mating segment 906 towards or into the elbow mating segment 908. This compresses the spring 916 and slides the retaining ring 910 along the elbow's annular channel. The annular channel is sufficiently dimensioned, and the spring force tensioned, such that the arm and elbow splines may decouple without the retaining ring and arm mating segment motion being stopped by an edge of the annular channel or unduly resisted by the spring force. When the spline sets decouple, the arm portion and elbow portion are free to rotationally move with respect to one another. Once a user positions the arm as desired with respect to the elbow, he or she may stop exerting force on the arm, thus permitting the spring 916 to exert outward force against the arm mating portion and recouple the arm splines 920 to the elbow splines 922. In this manner, a user may selectively rotate the arm with respect to the elbow, as desired.

Figure 24:
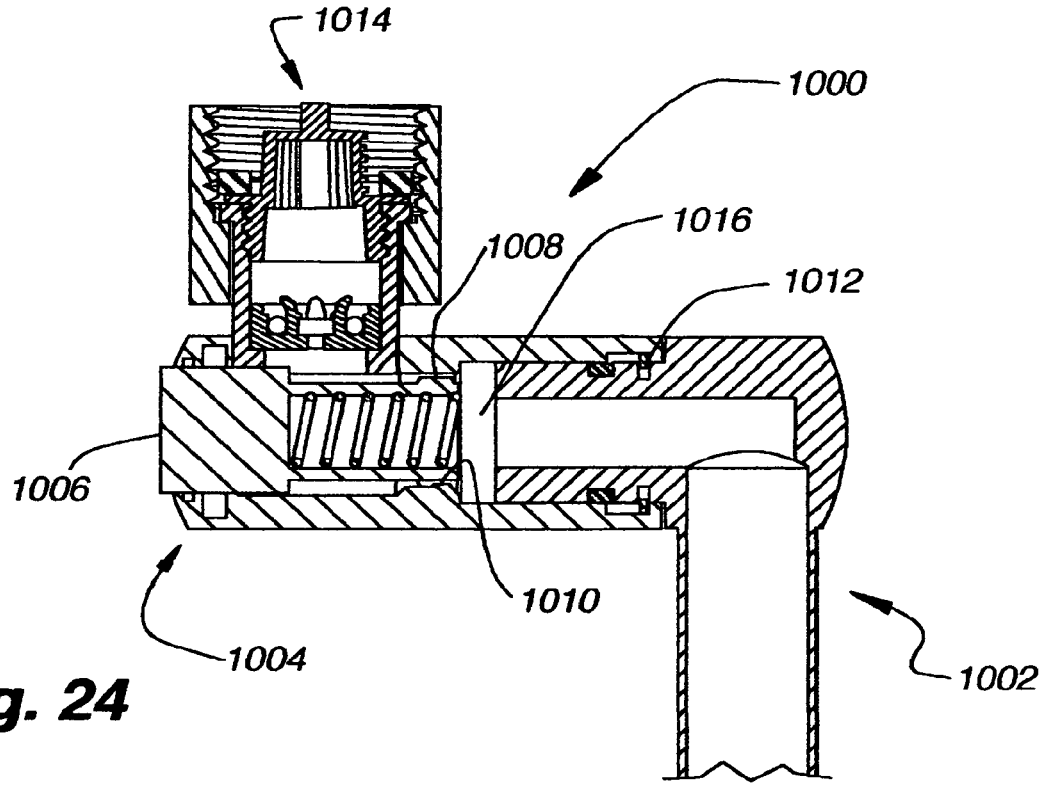
FIG. 24 depicts a cross-sectional view of an articulating arm employing hydraulic pressure to mate a first and second set of splines.

FIG. 24 depicts an alternative embodiment of an articulating arm 1000 employing an internal biasing force as a locking mechanism to prevent undesired rotation between the arm 1002 and elbow portions 1004. In this embodiment, hydraulic pressure from the liquid transported through the articulating arm provides the locking mechanism. In the present embodiment, a button 1006 is affixed to a button channel, which conveys water or other liquid from the inlet to the channel defined in the arm mating segment interior ("arm channel"). Button splines 1008 are affixed to an exterior of the button channel at the channel's distal end.

The arm mating segment includes a set of arm splines 1010 defined in the arm channel interior. The arm splines 1010 and button splines 1008 typically extend around a circumference of their respective channels, but may extend only partially along the respective circumferences.

The button and button 1006 channel may move inwardly and outwardly from the elbow portion 1004. When the button channel is positioned inwardly within the elbow portion, the button splines mate with the arm splines. This prevents rotational movement between the elbow and button channel, fixing these elements in place with respect to one another. By contrast, when the button and button channel are in an outwardly-extending position from the elbow portion, the button splines and arm splines disconnect, permitting free rotation of the arm portion with respect to the button channel.

One or more retaining projections 1012 extend inwardly from the elbow portion, seating in an equal number of annular channels defined in the button (or button channel) body. In the embodiment shown in FIG. 24, two retaining projections 1012 are present. The retaining projection(s) limits longitudinal motion between the button/button channel and elbow portion, ensuring the two do not decouple. Since one or more retaining projections are used instead of a continuous retaining ring, the button channel and elbow portion are rotationally coupled to one another. Thus, when the button channel is rotationally coupled to the arm portion via the mating of button and arm splines, the elbow portion is similarly coupled. Similarly, when the button channel and arm portion are rotationally decoupled, so too are the elbow and arm portions. In this manner, the elbow 1004 and arm 1002 portions may be rotationally coupled and decoupled in the following manner.

When water enters the elbow portion 1004, it flows from the inlet 1014, through the elbow mating segment, into the arm mating segment, and ultimately into the arm portion and attached showerhead. A restrictor plate 1016 is placed in-line in the arm channel. The restrictor plate's 1016 orifice diameter is substantially smaller than the diameter of the channel defined in the arm mating segment. Thus, water flow is limited by the restrictor plate. This limitation or restriction, in turn, creates backpressure in the section of the arm channel between the restrictor plate and inlet. The backpressure pushes the button channel and affixed button splines backward, mating the button splines with the arm splines.

It should be noted that the hydraulic pressure of flowing water may be used to couple the button 1008 and arm splines 1010 in a variety of ways. For example, instead of using backpressure to couple the spline sets, the restrictor plate 1016 may be placed in the button channel interior instead of the arm channel interior. In such an embodiment, the pressure exerted against the in-line restrictor plate may drive the button and button channel forward, engaging the spline sets. In the present embodiment, the restrictor plate 1016 is sized such that a user may pull or otherwise depress the button 1006 to decouple the splines and permit rotational motion between the arm and elbow portions. The restrictor plate 1016 is sized such that the backpressure exerts approximately the same resistance to pulling the button 1006 as a properly sized compression spring (for example, the same resistance exerted by the spring discussed with respect to FIG. 23). In an alternative embodiment, when water flow stops, the button may be depressed to permit the spline sets to decouple.

Figure 25:
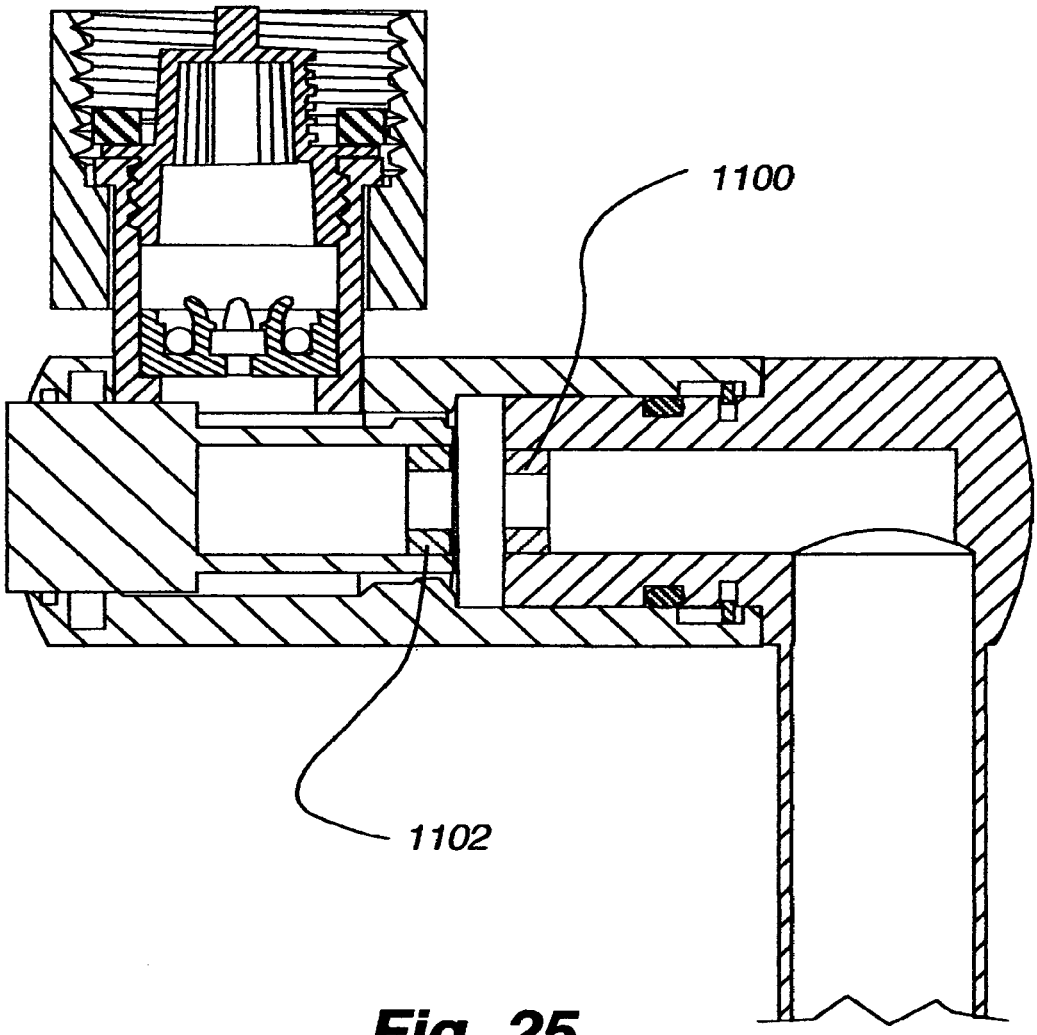
FIG. 25 depicts a cross-sectional view of an articulating arm employing magnets to mate a first and second set of splines.

Finally, FIG. 25 depicts yet another alternative embodiment of an articulating arm 1100 employing an alternative embodiment of a locking mechanism. This embodiment is structurally similar to that described with respect to FIG. 23, except that the spring is replaced by a pair of magnets 1102. In this embodiment, the magnets may be oriented either with similar poles facing each other (i.e., north pole facing north pole or south pole facing south pole) or with opposing poles facing one another. Each orientation will be discussed in turn.

Both magnetic embodiments include a button projecting outwardly from the end of the elbow portion 1104, an interior "button" channel for receiving and transporting water to the arm portion, and a set of button splines 1108 formed on the exterior of the button channel. The button channel is affixed to the button 1106. One magnet (or set of magnets) 1110 is affixed to the button channel, while the other magnet 112 (or set of magnets) is affixed to the arm mating segment 1114. The elbow mating segment includes a set of elbow splines as discussed previously. The button channel communicates with the water inlet and water flow channel formed in the arm portion. An optional seal 1116 may sit between the button channel and arm channel and prevent water from escaping into the rest of the articulating arm. The button channel and elbow mating portion are connected by one or more retaining projections 1118 seated in one or more annular channels. Although the present embodiment depicts the annular channel formed on the button channel exterior and the retaining projection projecting from the elbow interior, these elements may be reversed such that the annular channel is formed on the elbow interior and the retaining projection projects from the button channel exterior. This is true of any such embodiment described herein. As with the embodiment of FIG. 24, the combination of annular channel and retaining projection serve to fix the button and button channel rotationally with respect to the elbow portion, but permit the button and button channel to slide longitudinally along the elbow mating segment.

In an embodiment where like poles face (as shown in FIG. 25), the magnets exert a repulsive force against one another. This force pushes the arm mating segment outwardly from the elbow mating segment. That is, the magnets exert a decoupling force on the joinder of the mating segments.

The decoupling force pushes the button splines into a mating position with the elbow splines. This force also pushes the button outward from the body of the elbow portion. When the button is depressed by a user (i.e., pushed into the elbow portion body), the button splines slide forward, out of the elbow splines. Thus, the arm portion and elbow portion may rotate with respect to one another. When the user stops pressing the button, the repulsive magnetic force is drives the button splines backward to mate with the elbow splines and lock out rotational motion.

In an embodiment employing opposing poles facing one another, an attractive force is generated between magnets. This embodiment operates in substantially the same manner as the one just described, except that pulling the button will disengage the splines and allow rotation of the arm portion with respect to the elbow portion.

It should be noted that either of the embodiments shown in and discussed with respect to FIGS. 24 and 25 may be employed with the arm structure depicted in FIG. 23.

While the invention has been particularly shown and described with reference to certain embodiments, it will be understood by those skilled in the art that various other changes in the form and details may be made without departing from the spirit and scope of the invention. For example, the elbow portion 204 may have a receiving end defining a recess, while the arm portion 202 includes an insertion end previously identified with the elbow portion 204 (or vice versa with respect to the embodiments of FIGS. 17-25). Such a structure would allow the various embodiments of the invention to operate as described above.

Similarly, while the above-disclosed embodiments provide an arm portion directly connected to a shower head, and an elbow portion connected to a water supply pipe, other configurations regarding the connection of the shower arm to a water supply pipe and a shower head are possible. For example, the arm portion may be configured to receive a water supply pipe, while the elbow portion is adapted to connect to a shower head. In other words, the physical interconnection of the arm portion and the elbow portion may reside at either the water supply pipe end or the shower head end, or both, of the articulating shower arm.

Figure 15:
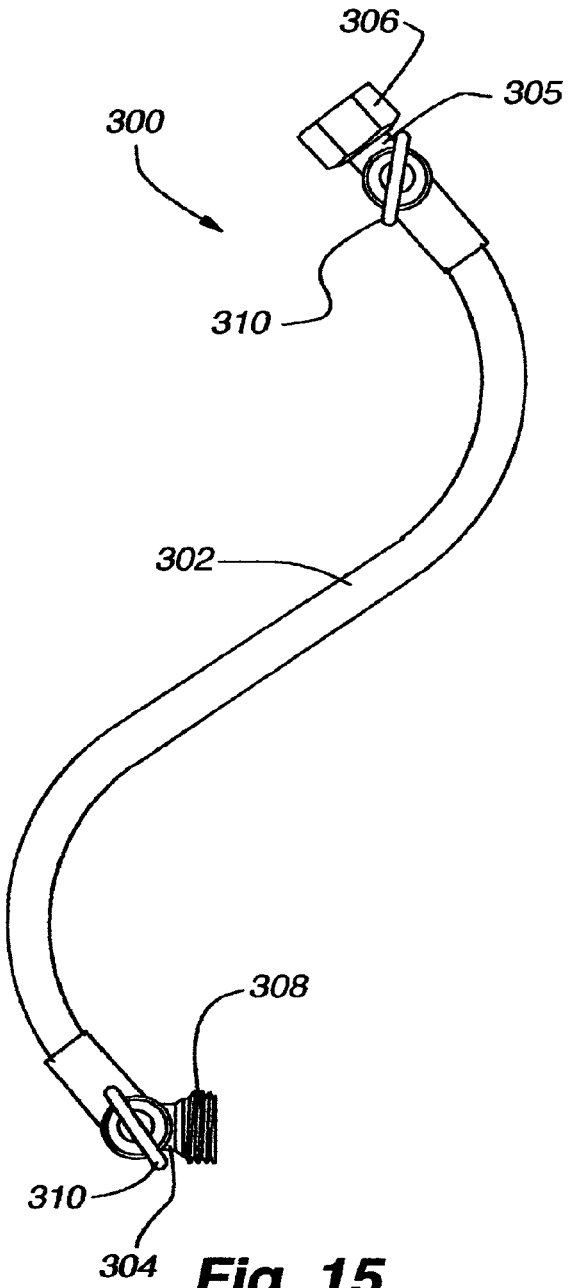
FIG. 15 depicts a side view of a S-shaped shower arm according to a third embodiment of the invention.
Figure 16:
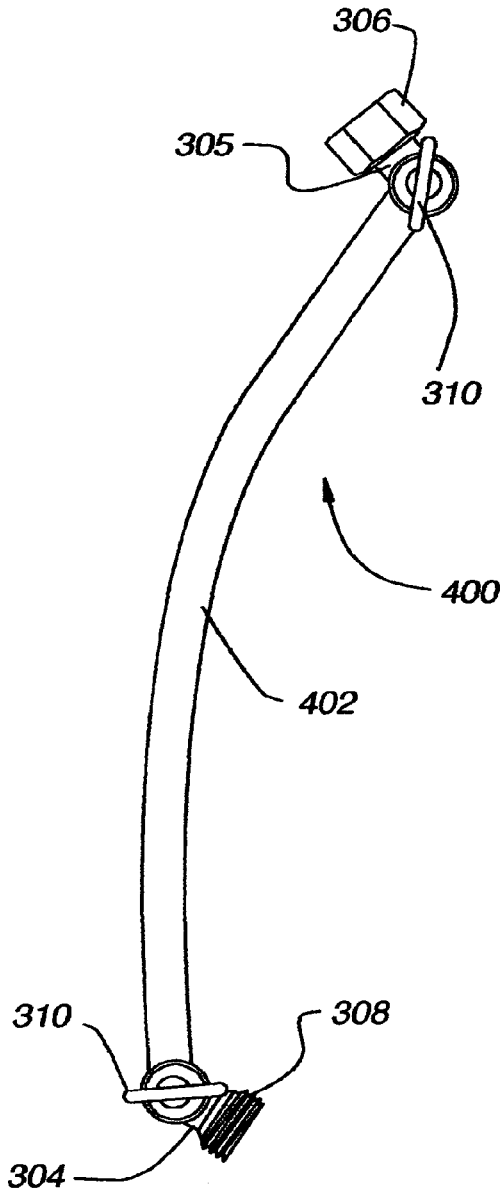
FIG. 16 depicts a side view of an arc-shaped shower arm according to a fourth embodiment of the invention.

Further, a shower arm may comprise several arm portions and elbow portions to allow pivoting in multiple locations along the shower arm. An S-shaped shower arm 300 (as shown in *Fig.* 15) and an arcuate shower arm 400 (depicted in FIG. 16) are examples of such embodiments of the invention. More specifically, the S-shaped shower arm 300 of FIG. 15 includes a S-shaped arm portion 302. One end of the arm portion 302 is coupled to a first elbow portion 304 having a shower head connector 308, and the opposing end of the arm portion 302 is connected to a second elbow portion 305 having a water supply connector 306. The angular position of each of the first and second elbow portions 304, 305 relative to the S-shaped arm portion 302 is adjustable as described above by way of a wing nut 310. Similarly, the arcuate shower arm 400 of FIG. 16 depicts a similar configuration employing an arcuate arm portion 402. As those of ordinary skill in the art will appreciate, myriad other articulated shower arm configurations employing the principles of the present invention are possible.

Additionally, while the embodiments discussed herein employ spline structures, other structures that selectively prevent pivoting of the arm portion about the elbow portion may be employed in alternate embodiments.

Further, while embodiments have been specifically described as forms of a shower arm, the present invention may be employed for other uses. For example, any fluids, such as liquids or gases, or solids, such as electrical wiring, may be conducted within various embodiments of the present invention. Thus, for example, embodiments of the invention may be particularly suitable as wiring conduits or gaseous tubing. Accordingly, the proper scope of the invention is defined by the appended claims, rather than the foregoing specification.

We claim:

1. An articulating shower arm, comprising an elbow portion adapted to fluidly communicate with a water supply;

a movable adjustment post comprising one or more post splines and having a first end operatively attached to an end of the elbow portion and a second end opposite the first end;

an arm portion comprising one or more arm splines and adapted to fluidly communicate with a shower head, wherein the arm portion is pivotably coupled with the elbow portion about a first axis of the elbow portion;

the arm portion and the elbow portion form a continuous channel configured to fluidly connect the water supply with the shower head;

the adjustment post extends within the channel in the elbow portion coaxially with the first axis of the elbow portion such that the second end extends through an exit opening in the arm portion; and a mechanism for selectively locking and unlocking the position of the arm portion relative to the elbow portion operatively attached to the second end of the adjustment post, wherein when the mechanism is in a locked configuration, the adjustment post is in a first position and the interaction of the one or more post splines with the one or more arm splines causes the arm portion to be held substantially immovable relative to the elbow portion; and when the mechanism is in an unlocked configuration, the adjustment post is in a second position and the arm portion is pivotable with respect to the elbow portion and the arm portion may be moved to a different radial location with respect to the elbow portion.

2. The articulating shower arm of claim 1, further comprising a spring disposed between the elbow portion and the adjustment post, the spring acting on the adjustment post to bias the adjustment post away from the elbow portion and towards to arm portion, and wherein the interaction of the one or more post splines with the one or more arm splines in the locked configuration is due to a force applied by the action of the spring.

3. The articulating shower arm of claim 2, wherein when the mechanism is in an unlocked configuration the adjustment post is displaced away from the arm portion against the action of the spring, and the displacement of the adjustment post causes the one or more post splines to disengage from the one or more arm splines thereby allowing the arm portion to pivot with respect to the elbow portion.

4. The articulating shower arm of claim 3, wherein the elbow portion includes a cavity and the first end of the adjustment arm moves within the cavity when the adjustment arm displaces due to the action of the mechanism for selectively locking and pivoting.

5. The articulating shower arm of claim 2, further comprising a retention mechanism operable to prevent the elbow portion from separating from the arm portion under the action of the spring.

6. The articulating shower arm of claim 5, wherein the retention mechanism comprises a retention groove in the adjustment post, the retention groove adapted to receive a set screw, the set screw disposed through a hole in the arm portion.

7. The articulating shower arm of claim 1, wherein the mechanism for selectively locking and pivoting comprises a button actuated locking mechanism.

8. The articulating shower arm of claim 7, wherein the adjustment post includes a threaded connection operable to attach the button actuated locking mechanism.

9. The articulating shower arm of claim 1, wherein the elbow portion includes an insertion end adapted to reside inside of a receiving end of the arm portion.

10. The articulating shower arm of claim 1, wherein the arm portion includes a short portion defining a first axis and a long portion defining a second axis configured substantially perpendicular to each other.

11. The articulating shower arm of claim 1, wherein the one or more post splines are complementary to the one or more arm splines.

12. The articulating shower arm of claim 1, wherein the one or more post splines are formed as ridges on an annular portion of the adjustment post parallel to the first axis of the elbow portion; and the one or more arm splines are formed as ridges on an inner diameter of the arm portion parallel to a second axis of the arm portion, wherein the second axis of the arm portion is perpendicular to a first axis of the arm portion.

13. The articulating shower arm of claim 1, further comprising a spring operably connected to the adjustment post, the spring acting on the adjustment post to bias the adjustment post towards the elbow portion and away from the arm portion, and wherein the interaction of the one or more post splines with the one or more arm splines in the locked configuration is due to a force applied by the action of the spring.

14. The articulating shower arm of claim 13, wherein the mechanism for selectively locking and pivoting comprises a push button actuated locking mechanism.

15. An articulating shower arm, comprising an elbow portion adapted to fluidly communicate with a water supply;

an adjustment post comprising one or more post splines and having a first end operatively attached to an end of the elbow portion and a second end opposite the first end;

an arm portion adapted to fluidly communicate with a shower head, wherein the arm portion is pivotably coupled with the elbow portion;

the arm portion and the elbow portion form a continuous channel configured to fluidly connect the water supply with the shower head;

the adjustment post extends within the channel in the elbow portion coaxially with a first axis of the elbow portion such that the second end extends through an exit opening in the arm portion; and a mechanism for selectively locking and unlocking the position of the arm portion relative to the elbow portion operatively attached to the second end of the adjustment post, wherein when the mechanism is in a locked configuration, the one or more post splines engages with one or more complimentary splines, the interaction of the one or more post splines with the one or more complimentary splines causes the arm portion to be held substantially immovable relative to the elbow portion; and when the mechanism is in an unlocked configuration, the arm portion is pivotable with respect to the elbow portion and the arm portion may be moved to a different radial location with respect to the elbow portion.

16. The articulating shower arm of claim 15, wherein the interaction of the one or more post splines with the one or more complimentary splines in the locked configuration is due to a force applied by the action of a spring.

17. The articulating shower arm of claim 16, wherein the spring is disposed between the elbow portion and the adjustment post, the spring acting on the adjustment post to bias the adjustment post away from the elbow portion and towards to arm portion.

18. The articulating shower arm of claim 17, wherein the one or more complimentary splines are disposed on the arm portion.

19. The articulating shower arm of claim 17, wherein the means for locking and pivoting is a push button.

20. The articulating shower arm of claim 16, wherein the spring is disposed between the arm portion and the adjustment post, the spring acting on the adjustment post to bias the adjustment post away from the arm portion and towards to elbow portion.

21. The articulating shower arm of claim 20, wherein the one or more complimentary splines are disposed on the elbow portion.

22. The articulating shower arm of claim 20, wherein the means for locking and pivoting is a pull button.

* * * * *